US011958508B2

(12) United States Patent
Ozaki

(10) Patent No.: US 11,958,508 B2
(45) Date of Patent: Apr. 16, 2024

(54) CONTROL SYSTEM AND CONTROL DEVICE FOR ELECTRIC RAILROAD CAR END DOOR

(71) Applicant: FUJI ELECTRIC CO., LTD., Kanagawa (JP)

(72) Inventor: Satoru Ozaki, Tokyo (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 719 days.

(21) Appl. No.: 17/104,447

(22) Filed: Nov. 25, 2020

(65) Prior Publication Data

US 2021/0230914 A1 Jul. 29, 2021

(30) Foreign Application Priority Data

Jan. 29, 2020 (JP) ..... 2020-012766
Oct. 13, 2020 (JP) ..... 2020-172591

(51) Int. Cl.
*B61D 19/00* (2006.01)
*B61D 19/02* (2006.01)

(52) U.S. Cl.
CPC ..... *B61D 19/026* (2013.01); *B61D 19/008* (2013.01)

(58) Field of Classification Search
CPC ..... B61D 19/026; B61D 19/008; B61D 19/02
USPC ..... 701/49
See application file for complete search history.

(56) References Cited

U.S. PATENT DOCUMENTS

2018/0209184 A1* 7/2018 Cencer ..... E05B 83/02
2021/0230914 A1* 7/2021 Ozaki ..... B61D 19/008

FOREIGN PATENT DOCUMENTS

CN 101166883 A * 4/2008 ..... E05F 15/40
JP 2014-095242 5/2014

* cited by examiner

*Primary Examiner* — Tyler D Paige
(74) *Attorney, Agent, or Firm* — IPUSA, PLLC

(57) ABSTRACT

A control system for an electrically-operated railroad car end door includes, an actuator, a processor, and a memory storing program instructions that cause the processor to instruct the actuator to begin generating a braking force applied to the railroad car end door in response to an opening of the railroad car end door, and determine whether the railroad car end door is being manually opened by a person based on information related to a state of the railroad car end door while the braking force is being generated.

19 Claims, 24 Drawing Sheets

CONTROL SYSTEM AND CONTROL DEVICE FOR ELECTRIC RAILROAD CAR END DOOR

CROSS-REFERENCE TO RELATED APPLICATION

This application is based upon and claims priority to Japanese Patent Application No. 2020-012766, filed on Jan. 29, 2020, and Japanese Patent Application No. 2020-172591, filed on Oct. 13, 2020, the entire contents of which are incorporated herein by reference.

BACKGROUND OF THE INVENTION

1. Field of the Invention

The present disclosure relates to a control system for an electric railroad car end door (i.e., an electric gangway door), a control device for the electric railroad car end door, and a non-transitory computer-readable recording medium having stored a control program for the electric railroad car end door.

2. Description of the Related Art

A device for maintaining a manually operated railroad car end door that is installed in a railroad car, in a fully open state or a fully closed state has been known (see Patent Document 1). The device is configured to maintain a railroad car end door in a fully open state or a fully closed state to be in the same state even when an external force, such as centrifugal force, vibrations, or impacts during traveling of a railroad car, is applied to the railroad car end door.

However, the above-described device cannot reduce a load required when a person manually opens a railroad car end door. This is because the device does not include a power source to move the railroad car end door. Moreover, even if the above-described device includes a power source, a load required when a person manually opens a railroad car end door cannot be appropriately reduced. This is because the device cannot detect that a person is manually opening the railroad car end door, and cannot appropriately control the timing of moving the railroad car end door.

Therefore, it is desirable to detect that a railroad car end door is being manually opened by a person.

RELATED-ART DOCUMENTS

Patent Document

[Patent Document 1] Japanese Laid-open Patent Publication No. 2014-95242

SUMMARY OF THE INVENTION

According to one aspect of an embodiment of the invention, a control system for an electrically-operated railroad car end door includes, an actuator, a processor, and a memory storing program instructions that cause the processor to instruct the actuator to begin generating a braking force applied to the railroad car end door in response to an opening of the railroad car end door, and determine whether the railroad car end door is being manually opened by a person based on information related to a state of the railroad car end door while the braking force is being generated.

According to at least one embodiment, the control system described above can detect that a railroad car end door is being manually opened by a person.

DETAILED DESCRIPTION OF THE EMBODIMENTS

Figure 1:
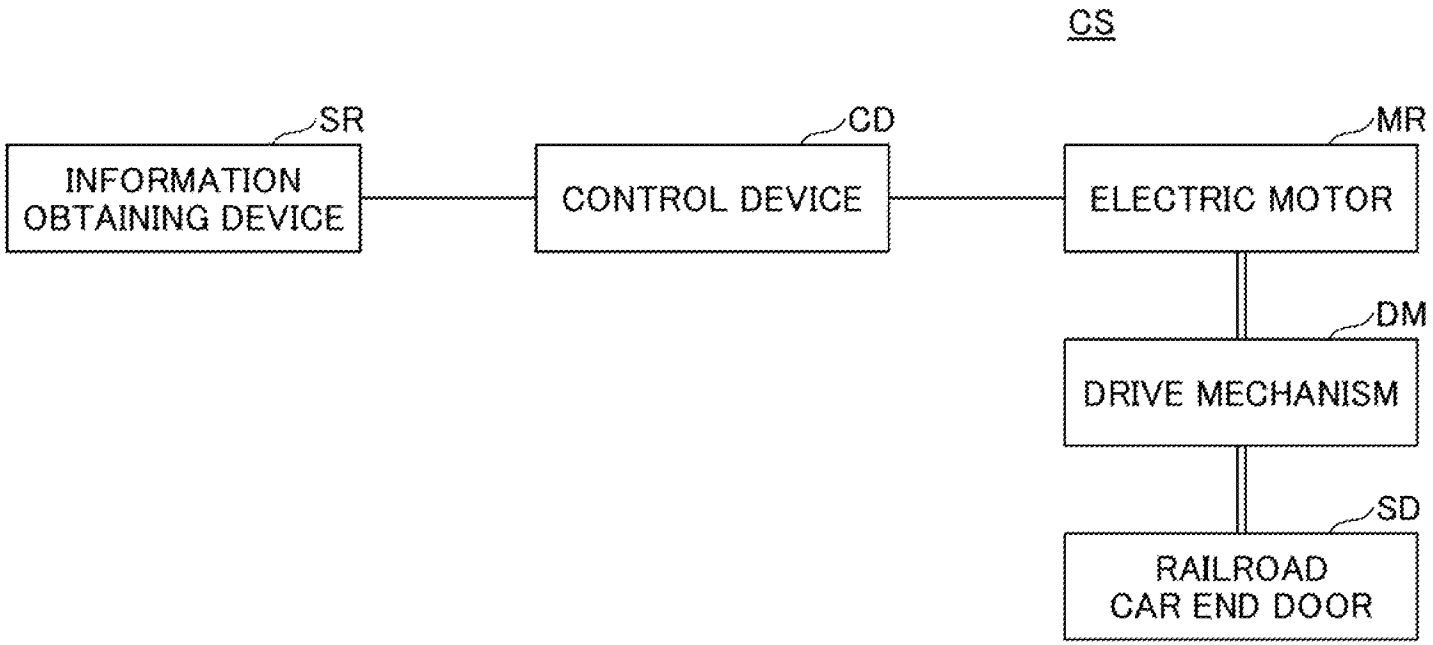
FIG. 1 is a schematic drawing of a control system of an electrically-operated railroad car end door.

In the following, a control system CS of an electrically operated railroad car end door SD (i.e., an electric railroad car end door SD) according to embodiments of the present invention will be described with reference to the drawings. The railroad car end door will be hereinafter referred to as the "end door". FIG. 1 is a schematic diagram of the control system CS. The control system CS mainly includes a control device CD, an information obtaining device SR, an electric motor MR, a drive mechanism DM, and the end door SD. The solid line connecting the control device CD and the information obtaining device SR indicates that the control device CD and the information obtaining device SR are electrically coupled. The same applies to a solid line connecting the control device CD and the electric motor MR. The double line connecting the electric motor MR and the drive mechanism DM indicates that the electric motor MR and the drive mechanism DM are mechanically connected. The same applies to the double line connecting the drive mechanism DM and the end door SD.

The control device CD is a microcomputer including a CPU, a volatile storage device, and a non-volatile storage device. The control device CD is configured to achieve various functions by executing, for example, a program stored in the non-volatile storage device.

The information obtaining device SR is configured to obtain information related to the end door SD. The information obtaining device SR may be, for example, a sensor for measuring a position of the end door SD. The sensor for measuring the position of the end door SD may be, for example, an encoder that detects a movement of the electric motor MR. The encoder may be a rotary encoder that detects a rotational position (i.e., the rotational angle) of a rotating shaft of a rotary motor used as the electric motor MR or a linear encoder for detecting a position of a movable portion of a linear motor used as the electric motor MR. The information obtaining device SR may include at least one of a sensor for detecting that the end door SD is in a fully closed position, a sensor that measures the current supplied to the electric motor MR, or a sensor that measures the voltage supplied to the electric motor MR. Here, the sensor for detecting that the end door SD is in the fully closed position may be configured to detect whether the end door SD is being opened. The sensor for detecting that the end door SD is in the fully closed position may be, for example, a contact sensor, such as a limit switch. However, the sensor for detecting that the end door SD is in the fully closed position may be a non-contact sensor, such as a proximity sensor.

The electric motor MR is configured to convert electrical energy to mechanical energy. The electric motor MR may be, for example, a rotary motor or a linear motor.

The drive mechanism DM is configured to use mechanical energy generated by the electric motor MR to move the end door SD. The drive mechanism DM may be, for example, a ball screw mechanism, a rack and pinion mechanism, or a direct drive mechanism using a linear motor.

The end door SD is a door installed on an end of a car to partition a through-passage (i.e., a gangway) provided between railroad cars. The end door SD may be double doors or a single door.

The end door SD is different from a side sliding door, which is a door for getting on and off a railroad car, installed on the sides of the railroad car. Electric side sliding doors are provided with a locking device that mechanically locks a fully closed side sliding door to prevent the side sliding door from opening during traveling of the railroad car with certainty. This is because the side sliding door cannot be completely prevented from opening due to, for example, vibrations or impacts only by using the mechanical energy generated by the electric motor MR to maintain the side sliding door in the fully closed state. The locking device is configured to prevent the side sliding door from opening due to any vibrations, impacts, and so on, and prevent passengers or the like from falling from the opened side sliding door while traveling of the railroad car with certainty.

With respect to the above, the end door SD is basically maintained in the fully closed state in order to maintain an environment inside the railroad car by using air conditioning or in order to prevent external noise from entering the railroad car. The end door SD is configured to be open only while a person passes through the end door SD. In order to prevent an inflow of smoke or toxic gas caused by a fire or the like occurred in another car, the end door SD is basically maintained in the fully closed state and is configured to open only while a person passes through the end door SD.

In Japan, the "Partial Revision of Interpretation Standards of Ministerial Ordinances, etc. Establishing Technical Standards for Railroads" issued on Dec. 27, 2004 prohibits an installation of a rigid stopper to maintain the end door SD in the fully open state.

As described above, the end door SD is basically configured to be fully closed and to be open while a person passes through the end door SD even during traveling of the railroad car. Thus, the end door SD may be opened while the railroad car is traveling due to vibrations, impacts, or external forces generated when the railroad car travels along a curve of a railroad track. Additionally, even when the railroad car is stopped, the end door SD may be opened due to an external force caused by gravity when the railroad car is tilted because of a cant provided at the curve of the railroad track. The "cant" is a height difference between top surfaces of a pair of rails laid on the curve of the railroad track and is provided so that the railroad car can safely travel by canceling centrifugal force applied to the railroad car traveling along the curve.

Therefore, in the present embodiment, the end door SD is configured to maintain the fully closed state when the end door SD receives a non-human external force. The "external force" is a force other than electric power, and a "human force" is an external force applied to the end door SD when a person is opening the end door SD. The "electric power" is a force generated by the electric motor MR.

As a means of maintaining the end door SD in the fully closed state, it can be considered to provide a locking mechanism similar to the locking mechanism used to maintain the side sliding door in the fully closed state. However, the through-passage in which the end door is provided can be an evacuation path for moving between cars in an emergency. Therefore, from a viewpoint of safety, it is not appropriate to use the locking mechanism as a means of maintaining the end door SD in the fully closed state. This is because there is a possibility that the end door SD cannot be opened due to, for example, a failure of the locking mechanism.

Thus, the end door SD is maintained in the fully closed state by a holding mechanism that generates a constant holding force, such as a mechanical latching mechanism using a spring or the like. When an external force exceeding the holding force is applied, the end door SD is configured to be released from the holding mechanism and to be opened.

The end door SD is configured to be automatically opened by the electric power when it is detected that a person is attempting to manually (i.e., by the human force) open the end door SD. The end door SD may be configured to be automatically opened by the electric power when a push-button switch installed near the end door SD is pressed, or when it is detected that a person approaches the end door SD by using an infrared sensor or the like installed near the end door SD, in addition to when it is detected that a person is attempting to manually (i.e., by the human force) open the end door SD.

However, only using a mechanical latch mechanism to maintain the end door SD in the fully closed state causes the end door SD to unnecessarily open when an external force exceeding the holding force of the latch mechanism is applied. In this case, the external force exceeding the holding force of the latch mechanism may result from, for example, vibrations or impacts during traveling of the railroad car, or centrifugal force generated when the railroad car travels along a curve of a railroad track.

The holding power may be increased to prevent the end door SD from unnecessarily opening. However, if the holding power became excessively strong, it would be difficult to manually (i.e., by the human force) open the end door SD when the electric motor MR is not available, for example, due to a power supply failure. This is not desirable from a view point of safety because the end door SD may be used for an evacuation path to an adjacent car.

Thus, the holding force of the latch mechanism is considered to be at a level at which manually opening the door, when power source is lost, is not inhibited. The end door SD is closed by the electric power when the end door SD is being opened by an external force exceeding the level. With this configuration, the control system CS can prevent the holding force of the latch mechanism from being stronger than necessary.

The control system CS of the electric end door SD is configured to determine whether the end door SD is being manually opened by a person or opened by a non-human external force, when the control system CS determines that the end door SD is being opened by an external force without being driven by the electric power. Preferably, the control system CS is configured to determine whether the end door SD is being manually opened by a person or opened by a non-human external force by using information utilized in control of the electric motor MR without using a special sensor, switch, or the like. Here, the "control of the electric motor MR" is, for example, control for opening and closing the end door SD. Additionally, the "special sensor, switch, or the like" includes, for example, an image sensor, such as a camera that obtains images for recognizing that a person is attempting to open the end door SD, an infrared sensor that detects approach of a person to the end door SD, a push-button switch for generating an open instruction to open the end door SD, or an electrostatic switch for detecting a touch of a person's hand on a handle of the end door SD. However, the control system CS does not exclude the installation of the "special sensor, switch, or the like".

The control system CS may be configured to determine whether the end door SD is being opened without control of the electric motor MR, based on an output of a sensor for measuring the position of the end door SD, instead of using a limit switch, a proximity sensor, or the like to detect whether the end door SD is being opened. Alternatively, the control system CS may be configured to determine whether the end door SD is being manually opened by a person or opened by a non-human external force.

The control system CS is configured to activate a door-closing operation when the control system CS determines that the end door SD is being opened by a non-human external force. The door-closing operation is an operation to close the end door SD by the electric power. For example, the control system CS operates the drive mechanism DM by using the force generated by the electric motor MR and moves the end door SD in a closing direction until the end door SD is fully closed.

The control system CS is configured to activate a door-opening operation when the control system CS determines that the end door SD is being manually opened by a person. The door-opening operation is an operation to open the end door SD by using the electric power. For example, the control system CS operates the drive mechanism DM by using the force generated by the electric motor MR and moves the end door SD in an opening direction until the end door SD is fully opened.

Next, a door opening force applied to the end door SD will be described. The door opening force applied to the end door SD is a force to open the end door SD, and mainly includes a door opening force resulting from the human force, a door opening force resulting from vibrations or impacts, a door opening force resulting from centrifugal force generated when a railroad car travels along a curve of a railroad track, and a door opening force resulting from a component force of gravity applied to the end door SD in the opening direction of the end door SD when a railroad car is tilted by a cant provided in a curve (which will be hereinafter referred to as an "opening force based on gravity").

The door opening force resulting from the human force is typically an external force that is continuously applied to the end door SD by a person who has an intention to release the end door SD from the holding mechanism and to move the end door SD in the opening direction. The magnitude of the door opening force resulting from the human force varies depending on each person who are opening the end door SD.

The door opening force resulting from vibrations or impacts is typically an external force applied to the end door SD for a shorter time period than a time period in which the door opening force resulting from the human force is applied to the end door SD. In some cases, the door opening force resulting from vibrations or impacts may be significantly greater than the door opening force resulting from the human force, but the application time period is at least several hundred milliseconds.

The door opening force resulting from centrifugal force and the door opening force based on gravity may continue for a long time, depending on operating conditions of the railroad car, but the magnitude is typically not very large. That is, although the door opening force resulting from centrifugal force and the door opening force based on gravity may continue for a longer time than the door opening force resulting from vibrations or impacts continue, the magnitude is typically smaller than the magnitude of the door opening force resulting from the human force and the magnitude of the door opening force resulting from vibrations or impacts.

By using the features described above of each door opening force applied to the end door SD, the control system CS can determine whether the end door SD is being manually opened by a person or opened by a non-human external force based on kinetic behavior when the end door SD is being opened by an external force. The control system CS automatically opens the end door SD by using the electric motor MR, for example, when the control system CS determines that the end door SD is being manually opened by a person. The control system CS automatically closes the end door SD by using the electric motor MR in order to maintain a fully closed state, for example, when the control system CS determines that the end door SD is being opened by a non-human external force.

In this case, the control system CS uses information related to a state of the end door SD in the opening direction of the end door SD as a directly measurable state amount. The information related to the state of the end door SD is based on information repeatedly obtained in a predetermined period by the information obtaining device SR, such as an encoder. The directly measurable state amount may be, for example, the position, speed, acceleration, or displacement amount of the end door SD in the opening direction of the end door SD. The speed of the end door SD may be derived by differentiating the positions of the end door SD, and the acceleration of the end door SD may be derived by differentiating the speeds of the end door SD. The displacement amount of the end door SD may be derived as a difference between a position of the end door SD at a first time point and a position of the end door SD at a second time point. The control system CS may also control, for example, an output of the electric motor MR that generates the electric power to hold or move the end door SD.

For example, in a configuration in which the end door SD is driven by the rotary motor, the information related to the state of the end door SD is, for example, the rotational position (i.e. the rotational angle), the rotation speed (i.e., the rotational angle speed), the rotation acceleration (i.e., the rotational angle acceleration), or the cumulative rotational angle, of the rotary motor. Alternatively, in a configuration in which the end door SD is driven by a linear motor, the information related to the state of the end door SD is, for example, the position, the movement speed, the movement acceleration, or, the accumulated movement distance, of a movable part of the linear motor. This is because the position, the movement speed, the movement acceleration, the accumulated movement distance, or the like, of the end door SD can be derived indirectly from the position, the movement speed, the movement acceleration, the accumulated movement distance, or the like, of the movable part of the electric motor MR.

Figure 2:
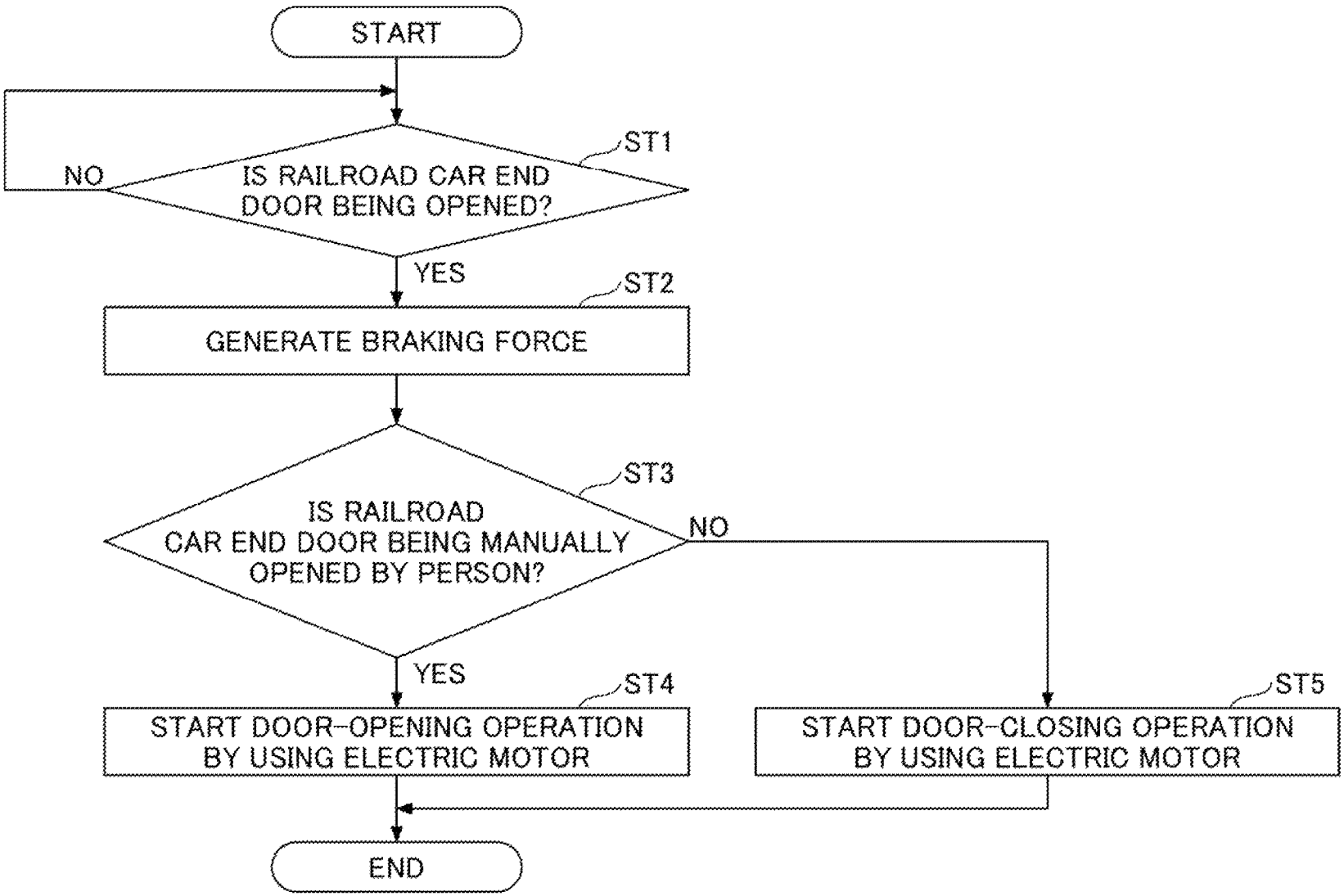
FIG. 2 is a flowchart of an assist process.

Next, an assist process achieved by the control system CS will be described with reference to FIG. 2. An assist process assists a person to open the end door SD. FIG. 2 is a flowchart of the assist process. In the example illustrated in FIG. 2, the assist process is performed when the end door SD is in the fully closed state.

In step ST1, the control system CS first determines whether the end door SD is being opened by an external force without the electric power. In the example illustrated in FIG. 2, the control system CS determines whether the end door SD is being opened based on an output of a limit switch installed in the end door SD. Here, the limit switch may be installed inside of a door pocket of the end door SD or outside of the door pocket of the end door SD, for example.

If the control system CS determines that the end door SD is being opened (YES in step ST1), in step ST2, the control system CS generates a braking force. The braking force is a force for reducing the movement speed of the end door SD. In the example illustrated in FIG. 2, a braking force is applied by the electric motor MR. However, the braking force may be applied by an actuator other than the electric motor MR.

In step ST3, the control system CS determines whether the end door SD is being manually opened by a person. In the example illustrated in FIG. 2, the control system CS measures the kinetic behavior of the end door SD when the end door SD is being opened by an external force in a state in which the braking force is applied to the end door SD. The control system CS then determines whether the end door SD is being manually opened by a person based on the measured kinetic behavior of the end door SD.

The reason for performing the determination while the braking force is being generated is that adding the braking force enhances the kinetic behavior of the end door SD and the following determination becomes easy. Specifically, in a state in which the braking force is not applied to the end door SD, that is, a state in which the end door SD is free to move, there is a possibility that the end door SD has been fully opened by a non-human external force before determining which external force is opening the end door SD. Alternatively, even when it can be determined that the end door SD is being manually opened by a person, there is a possibility that the end door SD has been already fully opened. In other words, if the braking force is not applied upon the opening of the end door SD, the control system CS cannot prevent the end door SD from being fully open due to a non-human external force, and the control system CS cannot timely assist a person in opening the end door SD.

The control system CS may determine whether the end door SD is being manually opened by a person or opened by a non-human external force based on the measured kinetic behavior of the end door SD and information related to the control of the electric motor MR. The Information related to the control of the electric motor MR is, for example, a thrust force command value f* or an actual thrust force value f, which will be described later.

If the control system CS determines that the end door SD is being manually opened by a person (YES in step ST3), in step ST4, the control system CS starts the door-opening operation performed by the electric motor MR. However, if the control system CS determines that the end door SD is being manually opened by a person, the control system CS may simply release the braking force without starting the door-opening operation performed by the electric motor MR.

If the control system CS cannot determine whether the end door SD is being manually opened by a person (NO in step ST3), the control system CS determines that the end door SD is being opened by a non-human external force. In step ST5, the control system CS starts the door-closing operation performed by the electric motor MR. If the control system CS cannot determine whether the end door SD is being manually opened by a person, the control system CS may terminate the assist process without starting the door-opening operation performed by the electric motor MR.

Next, with reference to FIGS. 3 to 6, an example of the kinematic behavior of the end door SD will be described. FIGS. 3 to 6 each illustrate temporal changes of the door opening force applied to the end door SD, the displacement amount of the end door SD, and the movement speed of the end door SD. Specifically, FIGS. 3 to 6 each have a horizontal axis as a time axis, and a vertical axis corresponding to the door opening force, the displacement amount, and the movement speed. FIGS. 3 to 6 each represent the changes of the door opening force with a solid line, the changes of the displacement amount with a dashed-dotted line, and the changes of the movement speed with a dashed-two-dotted line.

When the door opening force resulting from vibrations or impacts is smaller than the braking force and the time period in which the door opening force is continuously applied is relatively short (which will be hereinafter referred to as a "first case"), the end door SD starts to open at an initial speed determined based on the magnitude of the door opening force and inertia of the end door SD, as illustrated by the dashed-two-dotted line in FIG. 3, but stops in a short time due to the braking force. In the example illustrated in FIG. 3, the end door SD starts to open at a time t0 and stops at a time t1. The displacement amount L1 of the end door SD from when the end door SD opens to when the end door SD stops is not large.

When the door opening force resulting from vibrations or impacts is greater than the braking force and the time period in which the door opening force is continuously applied is relatively short (which will be hereinafter referred to as a "second case"), the end door SD starts to open at an initial speed determined based on the magnitude of the external force and inertia of the end door SD, as illustrated by the dashed-two-dotted line in FIG. 4. Subsequently, the speed of the end door SD is decreased by the braking force, but because the initial speed is greater than the initial speed in the case of FIG. 3, it takes some time to stop. In the example illustrated in FIG. 4, the end door SD starts to open at the time t0 and stops at the time t1. The displacement amount of the end door SD from when the end door SD opens to when the end door SD stops is significantly larger than the displacement amount L1 illustrated in FIG. 3. In the example illustrated in FIG. 4, the acceleration of the end door SD ends immediately after the opening of the end door SD.

When the door opening force resulting from vibrations or impacts is smaller than the braking force and the time period in which the door opening force is continuously applied is relatively long (which will be hereinafter referred to as a "third case"), the end door SD continues to accelerate until the braking force exceeds the door opening force as illustrated by the dashed-two-dotted line in FIG. 5, and then turns to slow down when the braking force exceeds the door opening force. However, the end door SD does not stop for a short time, not as in FIGS. 3 and 4, and it takes a relatively long time to stop.

When the door opening force resulting from vibrations or impacts is greater than the braking force and the time period in which the door opening force is continuously applied is relatively long (which will be hereinafter referred to as a "fourth case"), the end door SD continues to accelerate until the braking force exceeds the door opening force, as illustrated by the dashed-two-dotted line in FIG. 6. In the example illustrated in FIG. 6, the door opening force is a transient external force, and thus, decreases after a peak, and disappears before long, as illustrated by the solid line in FIG. 6.

In the examples illustrated in FIGS. 3 to 6, the end door SD stops before reaching a fully open position after moving in the opening direction because the door opening force resulting from vibrations or impacts is a transient external force. However, if the door opening force resulting from the human force is greater than the braking force, the end door SD typically continues to move in the opening direction until the end door SD opens so that at least a person can pass through the end door SD. Basically, the door opening force resulting from the human force is maintained greater than the braking force as long as a person is attempting to open the end door SD.

Figure 7:
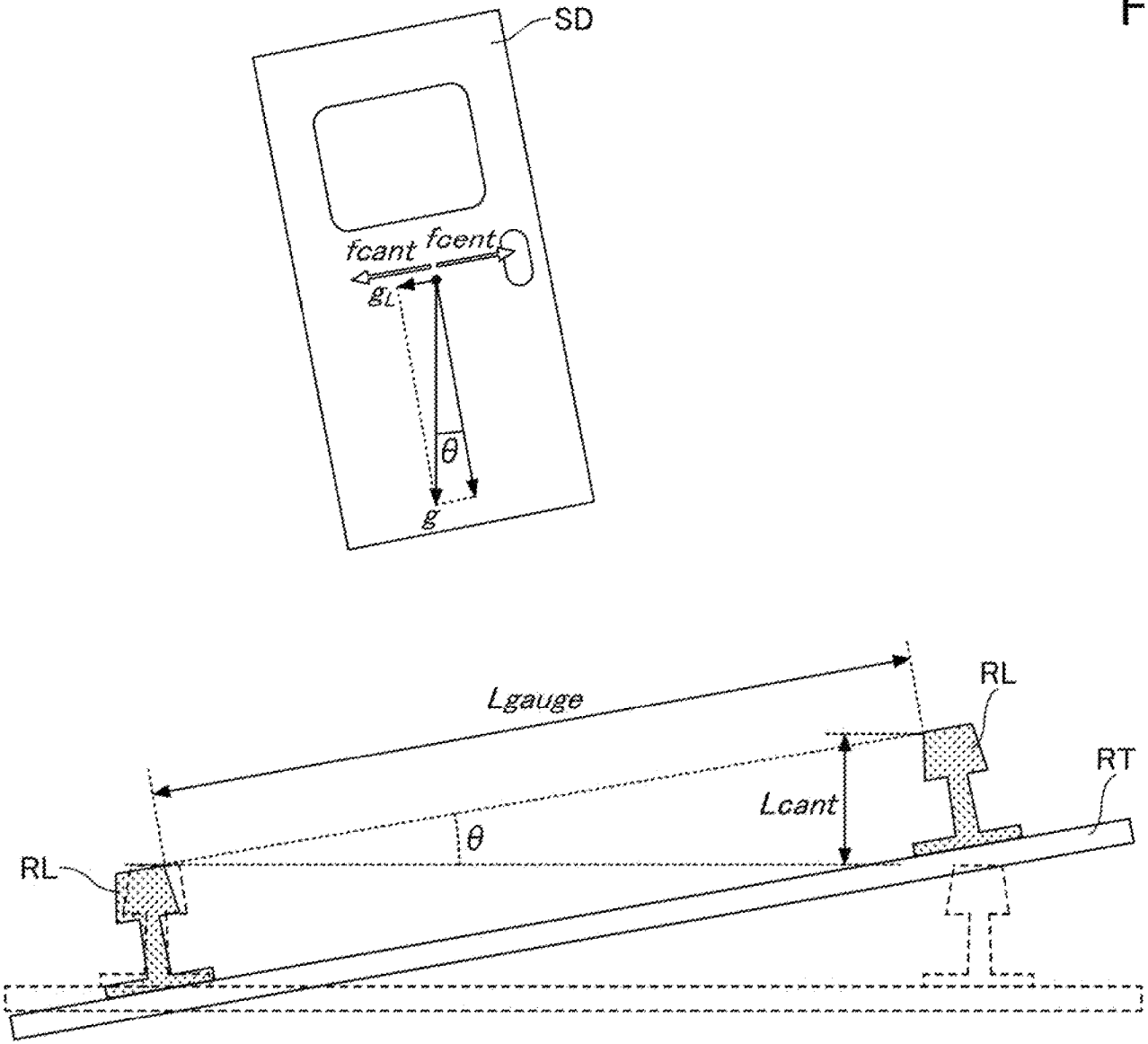
FIG. 7 is a drawing illustrating an external force acting on the railroad car end door in a railroad car traveling on a railroad track having a cant.

Next, with reference to FIG. 7, a door opening force resulting from centrifugal force fcent, and a door opening force based on gravity fcant, will be described. FIG. 7 is a drawing illustrating external forces acting on the end door SD installed in the railroad car traveling through a rail track having a cant, including a cross-section of each of rails RL and a railroad tie RT used by the railroad car. Specifically, FIG. 7 illustrates a state of the rails RL and the railroad tie RT when a cant value is zero with a dotted line, and a state of the rails RL and the railroad tie RT when a cant value is not zero with a solid line. FIG. 7 also schematically illustrates the end door SD installed in the railroad car (which is not illustrated) on a rail track having a non-zero cant value.

A force fc (which is not illustrated) applied to the end door SD in a direction of the railroad tie when the railroad car travels along a curve is expressed by the following equation using the door opening force resulting from centrifugal force fcent and the door opening force based on gravity fcant. Here, the "direction of the railroad tie" is a direction perpendicular to a traveling direction of the railroad car and parallel to a rail plane.

$$fc = fcent - fcant \qquad \text{[Eq. 1]}$$

$$fcent = m \times \frac{v^2}{r}$$

$$fcant = m \times g_L = m \times g \times \sin\theta = m \times g \times \frac{Lcant}{Lgauge}$$

In the above equation, m indicates the mass of the end door SD, v indicates the travel speed of the railroad car, r indicates a curve radius, g indicates the gravitational acceleration, $g_L$ indicates a component of the gravitational acceleration in the opening direction, Lgauge indicates a gauge (i.e., the width of the rail RL), and Lcant indicates a cant value.

As is clear from the above equation, the force fc applied to the end door SD greatly changes depending on conditions of a railroad track, such as the curve radius r or the cant value Lcant, or the travel speed v of the railroad car.

When the railroad car stops at a curve (which will be hereinafter referred to as a "fifth case"), the force fc applied to the end door SD is fc=fcent−fcant=−fcant, because the door opening force resulting from centrifugal force fcent is zero.

For example, in a railroad passenger corporation, the maximum value of the cant value Lcant is about 200 mm when the gauge Lgauge is a standard gauge of 1435 mm. In this case, if the mass m of the end door SD is 40 kg, the magnitude of the force fc applied to the end door SD |fc| (absolute value) is smaller than 60N, as illustrated in the following equation.

$$|fc| = |fcant| = \left| m \times g \times \frac{Lcant}{Lgauge} \right| = 40\ [\text{kg}] \times 9.8\ [m/s^2] \times \frac{200\ [\text{mm}]}{1435\ [\text{mm}]} = 54.6\ [\text{N}] \qquad \text{[Eq. 2]}$$

In this case, the time period in which the force fc is continuously applied to the end door SD may be long, but the magnitude is constant. Therefore, when the braking force exceeding the force fc applied to the end door SD is applied, the end door SD being opened slows down and stops before long.

When the railroad car travels along a curve at a relatively slow speed (which will be hereinafter referred to as a "sixth case"), the door opening force resulting from centrifugal force fcent and the door opening force based on gravity fcant continue to act on the end door SD for a longer time than the door opening force resulting from vibrations or impacts continues. However, the magnitude of the door opening force resulting from centrifugal force fcent is smaller than or equal to the magnitude of the door opening force based on gravity fcant. Additionally, the door opening force resulting from centrifugal force fcent and the door opening force based on gravity fcant are opposite to each other. Therefore, the magnitude of the force fc (absolute value), which is the total force of both forces, is smaller than or equal to the magnitude of the door opening force based on gravity fcant applied when the cant value is maximum. Therefore, even in the sixth case, once the braking force is applied, the end door SD being opened slows down and stops before long.

When the railroad car travels along a curve at a relatively high speed (which will be hereinafter referred to as a "seventh case"), the time period in which the door opening force resulting from centrifugal force fcent and the door opening force based on gravity fcant are continuously applied is considered to be approximately equivalent to the time period in which the railroad car travels along a curve at a relatively low speed in terms of a comparison with the time period in which the door opening force resulting from vibrations or impacts is continuously applied. That is, the time period in which the door opening force resulting from centrifugal force fcent and the door opening force based on gravity fcant are continuously applied in the seventh case is significantly longer than the time period in which the door opening force resulting from vibrations or impacts is continuously applied, as in the case in which the railroad car travels along a curve at a relatively low speed.

In the seventh case, each of the magnitude of the door opening force resulting from centrifugal force fcent and the magnitude of the door opening force based on gravity fcant may greatly change depending on the travel speed v of the railroad car, the curve radius r, or the cant value Lcant, but it is necessary to keep each of the magnitude of the door opening force resulting from centrifugal force fcent and the magnitude of the door opening force based on gravity fcant within a certain range from a viewpoint of passenger safety, ride comfort, and the like. Therefore, the magnitude of the force fc (absolute value), which is the total force of both forces, is actually smaller than or equal to the magnitude of the door opening force based on gravity fcant that is applied when the cant value is at a maximum. In this case, the direction of the force fc is the same as the direction of the door opening force resulting from centrifugal force fcent. Therefore, even in the seventh case, once the braking force is applied, the end door SD being opened slows down and stops before long.

Referring back to FIG. 1, the kinetic information available for the control system CS of the electric end door SD will be described. The kinetic information available for the control system CS includes information obtained from a rotary encoder that detects the rotational position (i.e., the rotational angle) of a rotating shaft of the rotary motor when a rotary motor is adopted as the electric motor MR.

A rotary encoder generally used in a system that performs digital control outputs a pulse signal having a frequency proportional to the number of rotations of a rotating portion of the encoder that rotates with the rotating shaft of the rotary motor.

Such a system typically calculates a period of the pulse signal and calculates the angular speed of rotation from a reciprocal of the period of the pulse signal or counts the number of pulses of the pulse signal output within a predetermined time period to obtain a value of the detected angular speed of rotation.

However, the end door SD that starts to move from the fully closed state (i.e., a, state in which the rotating shaft of the rotary motor is stationary), that is, the rotary motor that rotates at a low speed is to be controlled the control system CS. In particular, when the end door SD starts to move, the angular speed of rotation of the rotary motor is extremely low, and the frequency of the pulse signal output by the rotary encoder is extremely low. Thus, there is a problem that the accuracy of a detected value is low or a detection delay is very large. The same applies to a case in which a linear motor is adopted as the electric motor MR.

Thus, the control system CS is configured to use an appropriate combination of physical quantities that are basis of conditions for determining whether the end door SD is being manually opened by a person.

Specifically, the control system CS determines that the end door SD is being opened by a non-human external force when at least one of the following three conditions is satisfied based on the characteristics of the external force described above (i.e., the door opening force). In this case, the control system CS may start the door-closing operation. Additionally, the control system CS may determine that the end door SD is being manually opened by a person when it cannot be determined that the end door SD is being opened by a non-human external force. In this case, the control system CS may start the door-opening operation. For example, the control system CS may determine that the end door SD is being opened by a non-human external force when all three conditions are satisfied and start the closing door operation to fully close the end door SD. Further, the control system CS may determine that the end door SD is being manually opened by a person when none of the conditions is satisfied within a predetermined time period, and may start the door-opening operation to fully open the end door SD.

A first condition is that "the displacement amount of the end doo SD does not reach a predetermined value Lt even when a predetermined time period D1 has elapsed from when the generation of the braking force has started". The control system CS can determine whether the end door SD is being opened by a non-human external force in each of the first, fifth, and sixth cases described above by determining whether the first condition is satisfied.

A second condition is that "the deceleration when a predetermined time period D2 has elapsed from when the generation of the braking force has started is greater than a predetermined value DCt". The control system CS can determine whether the end door SD is being opened by a non-human external force in each of the second, sixth, and seventh cases described above by determining whether the second condition is satisfied.

A third condition is that "an estimated value of the door opening force has been smaller than or equal to a predetermined value Ft for a predetermined time period after the generation of the braking force has started. The control system CS can determine whether the end door SD is being opened by a non-human external force in each of the third, fourth, sixth, and seventh cases described above by determining whether the third condition is satisfied.

Then, the control system CS can determine that the end door SD is being manually opened by a person when none of the first to third conditions is satisfied even when a predetermined time period D4 has elapsed from when the generation of the braking force has started.

The control system CS can perform various determinations earlier, as the predetermined time periods D1 to D4, the predetermined value Lt as the displacement amount, the predetermined value DCt as the deceleration, and the predetermined value Ft as the estimated value of the door opening force decrease. Various determinations may include, for example, a determination whether the end door SD is being opened, a determination whether the end door SD is being opened by a non-human external force, and a determination whether the end door SD is being manually opened by a person. That is, as each of the values decreases, the control system CS can determine whether the end door SD is being manually opened by a person when the end door SD is slightly opened, and can reduce the load on a person opening the end door SD more effectively by starting the door-opening operation earlier.

However, as each of the values decreases, the control system CS might erroneously determine that the end door SD is being manually opened by a person more frequently even though the end door SD is actually being opened by a non-human external force.

With respect to the above, the door opening force based on gravity and the door opening force resulting from the human force are applied to the end door SD, whether or not the railroad car is traveling. The door opening force resulting from vibrations or impacts and the door opening force resulting from centrifugal force are basically applied to the end door SD only when the railroad car is traveling.

Therefore, the control system CS can more effectively reduce the load on a person opening the end door SD by decreasing each of the values relative to each of the values used when the railroad car is traveling, if the control system CS can detect that the railroad car is stopped. This is because a frequency of erroneous determinations does not increase even when each of the values decreases.

Conversely, if the control system CS can detect that the railroad car is traveling, the erroneous determinations described above can be prevented by increasing each of the values to be greater than each of the values used when the railroad car is stopped. By preventing the erroneous determination, the control system CS can prevent starting the door-closing operation even when the end door is being manually opened by a person and prevent starting the door-opening operation even when the end door SD is being opened by a non-human external force.

Information indicating whether the railroad car is traveling or stopped is extremely basic information for the railroad car. Thus, the control system CS can easily utilize such basic information under any circumstances.

With the above-described configuration, the control system CS can reduce the holding force provided by the holding mechanism to hold the end door SD in the fully closed state, thereby reducing the load on a person manually opening the end door SD and increasing the convenience of the end door SD for users. Moreover, the control system CS can more accurately determine whether the end door SD is being manually opened by a person. Thus, when the control system CS has determined that the end door SD is being manually opened by a person, the control system CS can automatically open the end door SD by performing the door-opening operation. Therefore, the control system CS can further reduce the load on a person opening the end door SD and further increase the convenience of the end door SD for users.

The control system CS can more accurately determine whether the end door SD is being opened by a non-human external force. Therefore, when the control system CS has determined that the end door SD is being opened by a non-human external force, the control system CS can automatically close the end door SD by performing the door-closing operation.

The control system CS can determine whether the end door SD is being manually opened by a person without providing a special sensor, switch, or the like. When the control system CS has determined that the end door SD is being manually opened by a person, the control system CS can automatically open the end door SD by performing the door-opening operation.

When the control system CS achieves the above-described function by utilizing digital control that detects information related to the state of the end door SD based on the pulse signal output by the encoder, the movement speed of the end door SD may be separately obtained in multiple stages and various determinations may be performed using the physical quantities suitable for respective stages.

For example, at an initial stage in which the movement speed of the end door SD (i.e., the rotation speed of the rotating shaft of the electric motor MR) is low, the control system CS may determine, for example, whether the end door SD is being manually opened by a person based on a detected position value derived from an integrated value of the number of pulses of the pulse signal.

At a stage in which the movement speed of the end door SD (i.e., the rotation speed of the rotating shaft of the electric motor MR) increases such that a speed value detected with high accuracy (i.e., a time derivative value of the detected position values) can be obtained, the control system CS may determine, for example, whether the end door SD is being manually opened by a person based on the detected speed value.

At an stage in which the movement speed of the end door SD (i.e., the rotation speed of the rotational axis of the electric motor MR) further increases such that an acceleration value detected with high accuracy (i.e., a time derivative value of the detected speed values) can be obtained, the control system CS may determine, for example, whether the end door SD is being manually opened by a person based on an estimated external force value derived from the detected acceleration value.

The control system CS may perform a determination based on the detected position value, a determination based on the detected speed value, and a determination based on the estimated external force value in order, and when the control system CS has determined that the end door SD is being manually opened by a person in all the determinations, the control system CS may ultimately determine that the end door SD is being manually opened by a person.

Alternatively, the control system CS may perform the determination based on the detected position value and the determination based on the detected speed value in order, and when the control system CS has determined that the end door SD is being manually opened by a person in the determinations, the control system CS may ultimately determine that the end door SD is being manually opened by a person. The same will apply to a case of performing the determination based on the detected position value and the determination based on the estimated external force value in order, or a case of performing the determination based on the detected speed value and the determination based on the estimated external force value in order.

The control system CS may detect whether the railroad car is stopped based on information indicating whether the railroad car is traveling. When the control system CS has detected a state of being stopped in which there is no influence of the door opening force resulting from vibrations or impacts, values such as threshold values used for various determinations may be changed to values other than the values used when the railroad car is traveling. Various determinations include, for example, a determination whether the end door SD is being manually opened by a person and a determination whether the end door SD is being opened by a non-human external force. This configuration enables the control system CS to further improve the operability of the end door SD when a user manually opens the end door SD.

Figure 8A:
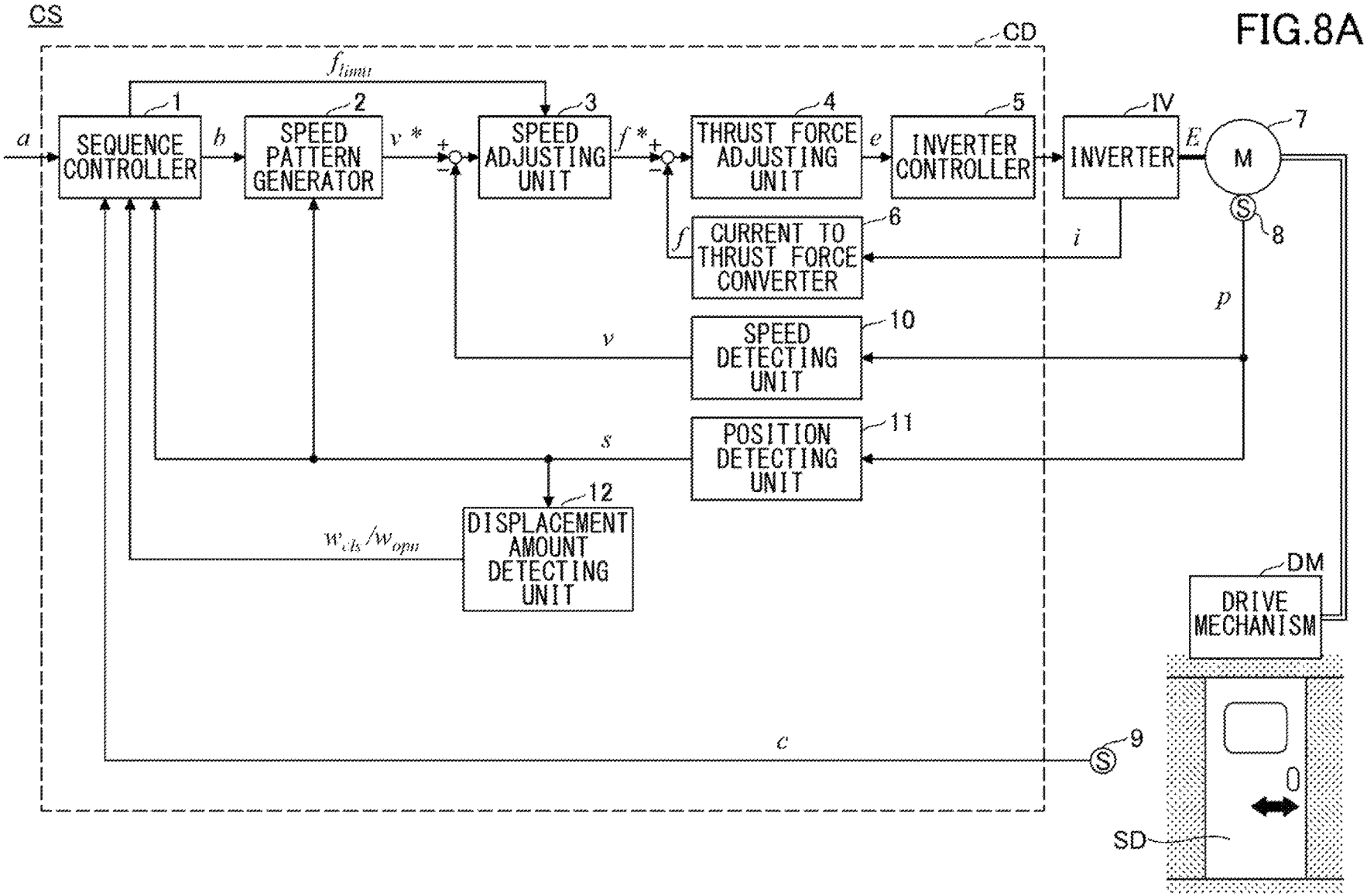
FIG. 8A is a control block diagram of an example of a control system according to a first embodiment.

Next, a first embodiment of the control system CS will be described with reference to FIG. 8A. FIG. 8A is a control block diagram of an example of a control system CS according to the first embodiment. In the example illustrated in FIG. 8A, the control system CS mainly includes a sequence controller 1, a speed pattern generator 2, a speed adjusting unit 3, a thrust force adjusting unit 4, an inverter controller 5, a current to thrust force converter 6, a rotary motor 7, an encoder 8, a door closed switch 9, a speed detecting unit 10, a position detecting unit 11, a displacement amount detecting unit 12, the drive mechanism DM, and an inverter IV.

The sequence controller 1 is configured to perform sequence control of opening and closing the end door SD. In the example illustrated in FIG. 8A, the sequence controller 1 is configured to generate a control command b based on an opening/closing command a of the end door SD and position information s of the end door SD.

The opening/closing command a is, for example, an opening command output by an open button switch that is one of the push button switches installed near the end door SD when the open button switch is pressed, or a closing command output by a close button switch that is another one of the push button switches when the close button is pressed.

The position information s is information related to a state of the end door SD detected by the position detecting unit 11 based on a pulse signal p output by the encoder 8.

The control command b is, for example, a command related to a movement direction of the end door SD or a displacement amount to a target position. The target position is, for example, a fully open position when the movement direction of the end door SD is the opening direction, or a fully closed position when the movement direction of the end door SD is the closing direction.

The speed pattern generator 2 is configured to generate a speed command value v*. In the example illustrated in FIG. 8A, the speed pattern generator 2 is configured to generate the speed command value v* based on the control command b from the sequence controller 1 and the position information s of the end door SD.

The speed adjusting unit 3 is configured to generate a thrust force command value f*. In the example illustrated in FIG. 8A, the speed adjusting unit 3 is configured to generate a thrust force command value f* so as to match an actual speed value v and the speed command value v*. Specifically, the speed adjusting unit 3 is configured to generate the thrust force command value f* based on a difference between the actual speed value v and the speed command value v*, which is the value obtained by subtracting the actual speed value v from the speed command value v*. More specifically, the speed adjusting unit 3 is configured to generate the thrust force command value f* through feedback control such as PID control. The speed adjusting unit 3 is configured to limit the thrust force command value f* so that the thrust force command value f* does not exceed a thrust force limit value $f_{limit}$.

The actual speed value v is information related to the speed of the end door SD detected by the speed detecting unit 10 based on the pulse signal p output by the encoder 8.

The thrust force limit value '$f_{limit}$' is a value calculated by the sequence controller 1 based on the open/close command a and the position information s.

The thrust force adjusting unit 4 is configured to generate an operation amount e. In the example illustrated in FIG. 8A, the thrust force adjusting unit 4 is configured to generate the operation amount e so that the actual thrust force value f and the thrust force command value f* match. Specifically, the thrust force adjusting unit 4 is configured to generate the operation amount e based on a difference between the actual thrust force value f and the thrust force command value f*, which is a value obtained by subtracting the actual thrust force value f from the thrust force command value f*. More specifically, the thrust force adjusting unit 4 is configured to generate the operation amount e through feedback control such as PID control. The thrust force adjusting unit 4 outputs the generated operation amount e to the inverter controller 5.

The actual thrust force value f is calculated by the current to thrust force converter 6 based on the current i output by the inverter IV, and corresponds to the thrust force generated by the rotary motor 7 that is an AC electric motor for moving the end door SD.

The inverter controller 5 is configured to control the inverter IV based on the operation amount e from the thrust force adjusting unit 4. In the example illustrated in FIG. 8A, the inverter controller 5 controls the inverter IV (i.e., the rotary motor 7) by using PWM control.

The inverter IV is configured to move the end door SD by supplying electric power E to the rotary motor 7. Specifically, the inverter IV converts DC electric power to three-phase AC electric power and supplies the three-phase AC electric power to the rotary motor 7.

The current to thrust force converter 6 detects the current i output by the inverter IV and outputs the actual thrust force value f equivalent to a thrust force generated by the rotary motor 7. If the rotary motor 7 is a three-phase AC electric motor, the current to thrust force converter 6 includes, for example, two current sensors provided in two of three power lines respectively corresponding to a U-phase, a V-phase, and a W-phase connecting the inverter IV and the rotary motor 7. In this case, the current sensor may be a contact sensor or a non-contact sensor, such as a current transformer or a Hall element.

Here, as the rotary motor 7, which is a driving device of the end door SD, the AC electric motor driven by the inverter IV is applied. However, a DC electric motor driven by a DC chopper or a PWM converter instead of the inverter IV may be applied.

Figure 8B:
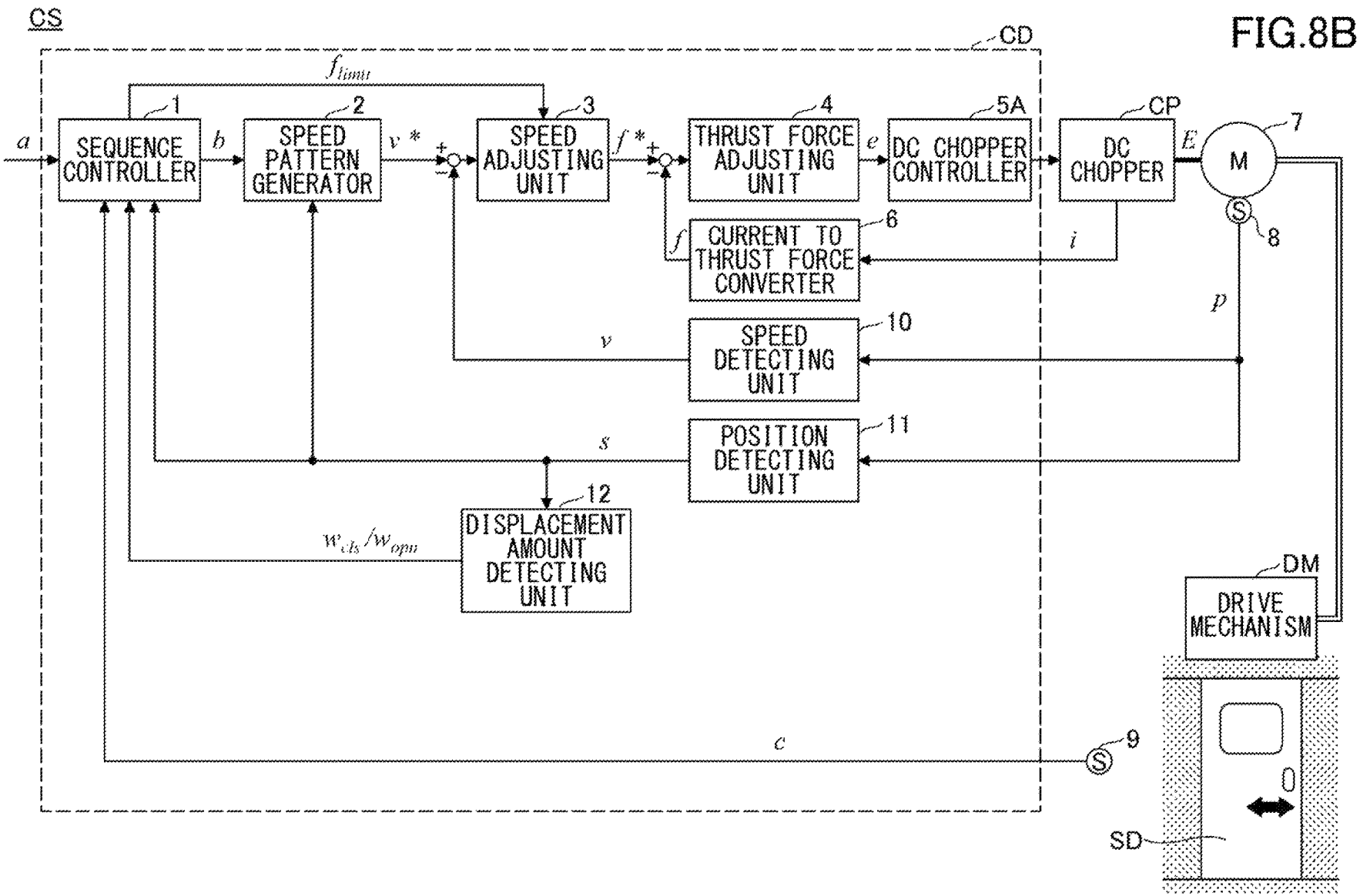
FIG. 8B is a control block diagram of another example of the control system according to the first embodiment.

FIG. 8B is a control block diagram of another example of the control system according to the first embodiment. In the example illustrated in FIG. 8B, a DC chopper controller 5A is used instead of the inverter controller 5 and a DC chopper CP is used instead of the inverter IV. Additionally, in the example illustrated in FIG. 8B, the rotary motor 7 is a DC electric motor.

The encoder 8 is a rotary encoder and is configured to output a pulse signal p for detecting the angular speed of the rotating shaft in accordance with the rotation of the rotating shaft of the rotary motor 7. If the electric motor MR is a linear motor, the encoder 8 is a linear encoder and may be configured to output a pulse signal for detecting the movement speed in accordance with the movement of the end door SD (i.e., the movement of the movable part of the linear motor).

The door closed switch 9 is configured to output a fully closed signal c when the end door SD is in the fully closed position. In other words, the door closed switch 9 is configured not to output the fully closed signal c when the end door SD is not in the fully closed position. Specifically, the door closed switch 9, for example, sets the fully closed signal c to an on level (i.e., a high voltage level) when the end door SD is in the fully closed position and sets the fully closed signal c to an off level (i.e., a low voltage level) when the end door SD is not in the fully closed position.

The speed detecting unit 10 is configured to derive the actual speed value v of the end door SD from the number of pulses (i.e., corresponding to the frequency) of the pulse signal p output by the encoder 8 within a predetermined time period or from a reciprocal of the period of the pulse signal p.

The position detecting unit 11 is configured to detect the position information s of the end door. SD by integrating the numbers of pulses of the pulse signal p output by the encoder 8.

The displacement amount detecting unit 12 is configured to detect the displacement amount of the end door SD. Specifically, the displacement amount detecting unit 12 is configured to detect the displacement amount of the end door SD based on the position information s. More specifically, the displacement amount detecting unit 12 detects the displacement amount of the end door SD in a time period between the first time point and the second time point based on a difference between the position information s detected at the first time point and the position information s detected at the second time point.

The displacement amount detecting unit 12 determines whether the end door SD is being manually opened by a person or opened by a non-human external force based on the displacement amount of the end door SD.

Figure 9:
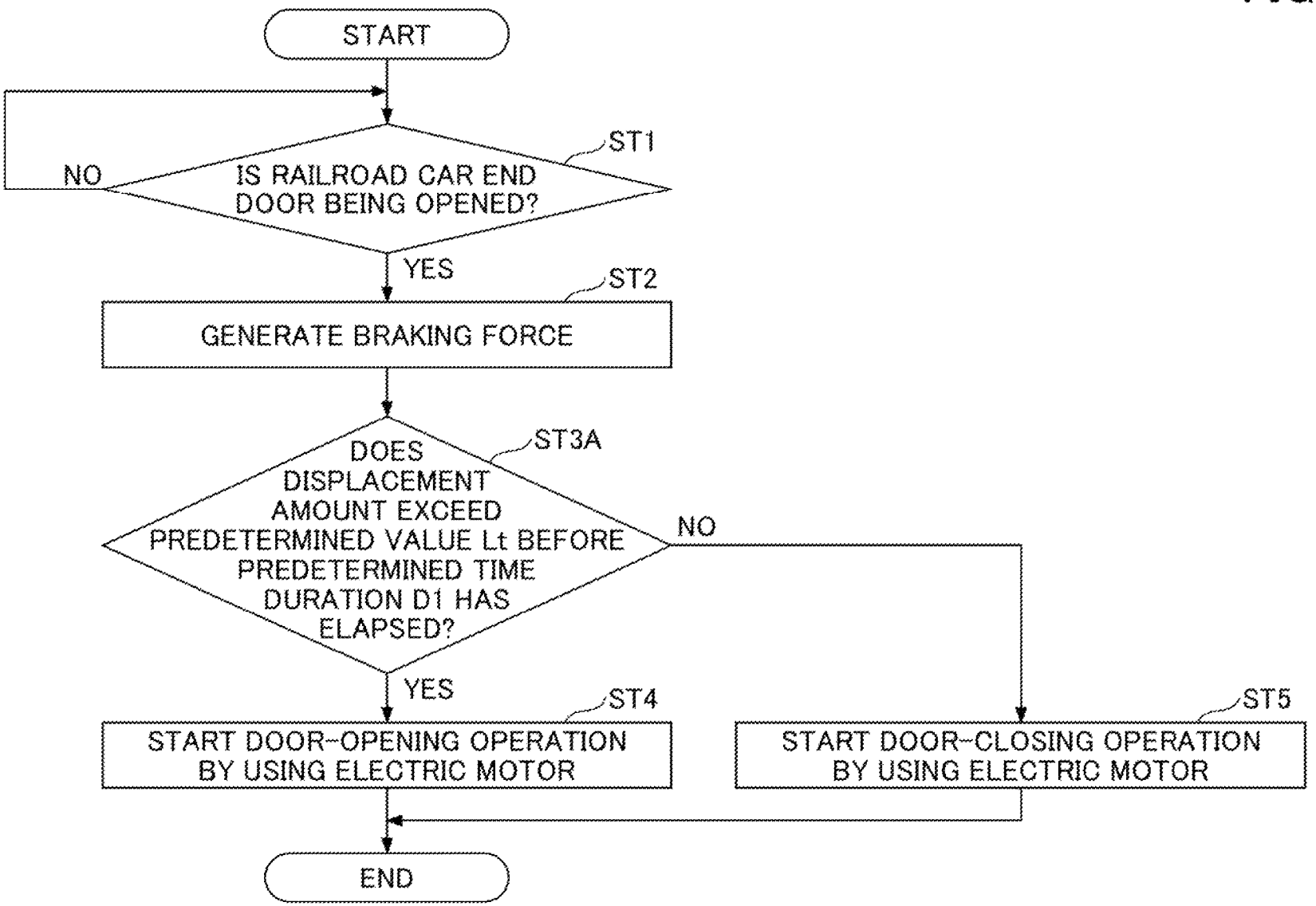
FIG. 9 is a flowchart of an assist process performed by the control system according to the first embodiment.

Next, an assist process performed in the control system CS of the first embodiment will be described with reference to FIG. 9. FIG. 9 is a flowchart of the assistant process performed in the control system CS of the first embodiment. The flowchart illustrated in FIG. 9 differs from the flowchart illustrated in FIG. 2 in that the flowchart includes step ST3A representing specific contents of step ST3 illustrated in FIG. 2. However, the flowchart illustrated in FIG. 2 and the flowchart illustrated in FIG. 9 have other features in common.

First, in step ST1, the sequence controller 1 determines whether the end door SD is being opened. In the example illustrated in FIG. 2, the sequence controller 1 determines whether the end door SD is being opened based on the level of the fully closed signal c while the inverter IV is stopped. However, the sequence controller 1 may determine whether the end door SD is being opened based on the position information s of the end door SD. In this case, the door closed switch 9 may be omitted.

If the sequence controller 1 detects that the end door SD is being opened (YES in step ST1), in step ST2, the sequence controller 1 generates the braking force. Specifically, the sequence controller 1 outputs the control command b to the speed pattern generator 2 so that the speed command value v* becomes zero. In this case, the inverter controller 5 operates the inverter IV so that the angular speed of the rotating shaft of the rotary motor 7, which is an example of the electric motor MR, is maintained at zero (i.e., in the stopped state). The sequence controller 1 outputs a predetermined braking force setting value as a thrust force limit value $f_{limit}$ to the speed adjusting unit 3. In this case, the thrust force command value f* output by the speed adjusting unit 3 is limited by the braking force setting value. As a result, the braking force generated by the rotary motor 7 is limited to the magnitude corresponding to the braking force setting value.

Subsequently, in step ST3A, the displacement amount detecting unit 12 determines whether the displacement amount of the end door SD exceeds the predetermined value Lt (see FIG. 3) before the predetermined time period D1 (see FIG. 3) has elapsed after braking is started.

Then, after braking is started and before the predetermined time period D1 has elapsed, if the displacement amount detecting unit 12 determines that the displacement amount of the end door SD exceeds the predetermined value Lt (YES in step ST3A), the displacement amount detecting unit 12 determines that the end door SD is being manually opened by a person. In this case, in step ST4, the displacement amount detecting unit 12 starts the door-opening operation by using the electric motor MR. Specifically, the displacement amount detecting unit 12 outputs a control command $w_{opn}$ to the sequence controller 1. The sequence controller 1 starts the door-opening operation in response to receiving the control command $w_{opn}$ so that the end door SD is opened by the electric power. That is, the displacement amount detecting unit 12 continues to move the end door SD being manually opened by a person in the opening direction by using the electric power.

If the displacement amount detecting unit 12 determines that the displacement amount of the end door SD has not reached the predetermined value Lt, even after the predetermined time period D1 has elapsed (NO in step ST3A), the displacement amount detecting unit 12 determines that the end door SD is being opened by a non-human external force. The kinetic behavior of the end door SD illustrated in FIG. 3 corresponds to this case. In this case, in step ST5, the displacement amount detecting unit 12 starts the door-closing operation by using the electric motor MR. Specifically, the displacement amount detecting unit 12 outputs a control command $w_{cls}$ to the sequence controller 1. The sequence controller 1 starts the closing door operation in response to receiving the control command $w_{cls}$ so that the end door SD being opened by a non-human external force is closed by the electric power.

Figure 3:
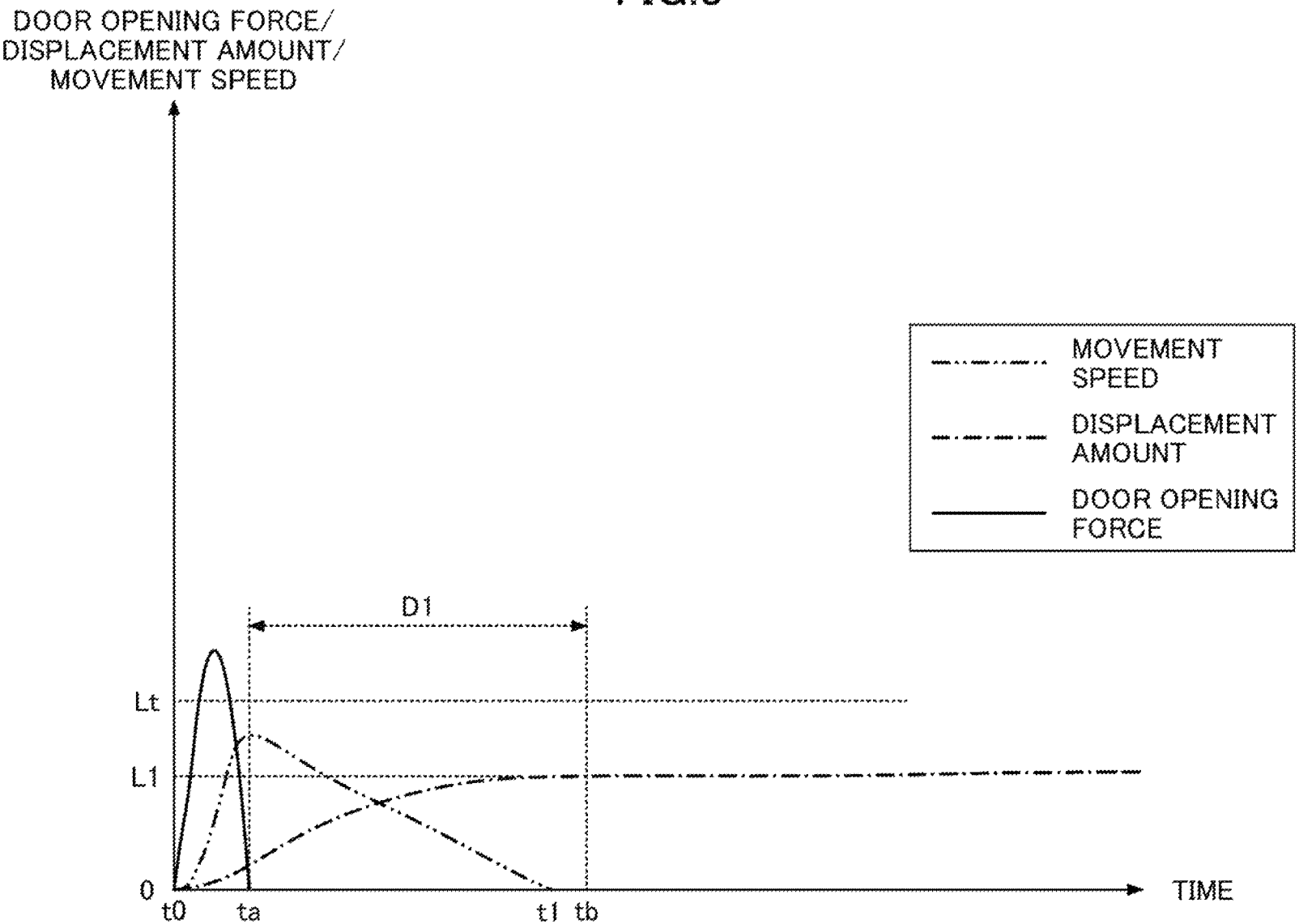
FIG. 3 is a drawing illustrating changes of a door opening force of the railroad car end door, the amount of movement of the railroad car end door, and the speed of movement of the railroad car end door.

Specifically, as illustrated in FIG. 3, when the door opening force applied to the end door SD, the displacement amount of the end door SD, and the movement speed of the end door SD change, the sequence controller 1 detects that the end door SD is being opened at the time to and generates the braking force.

Then, at the time tb, the displacement amount detecting unit 12 determines that the displacement amount of the end door SD does not reach the predetermined value Lt even when the predetermined time period D1 has elapsed, and determines that the end door SD is being opened by a non-human external force. In this case, the displacement amount detecting unit 12 outputs the control command $w_{cls}$ to the sequence controller 1. The sequence controller 1 starts the door-closing operation in response to receiving the control command $w_{cls}$ so that the end door SD being opened by an external force other than manual force is closed by the electric power.

Figure 10:
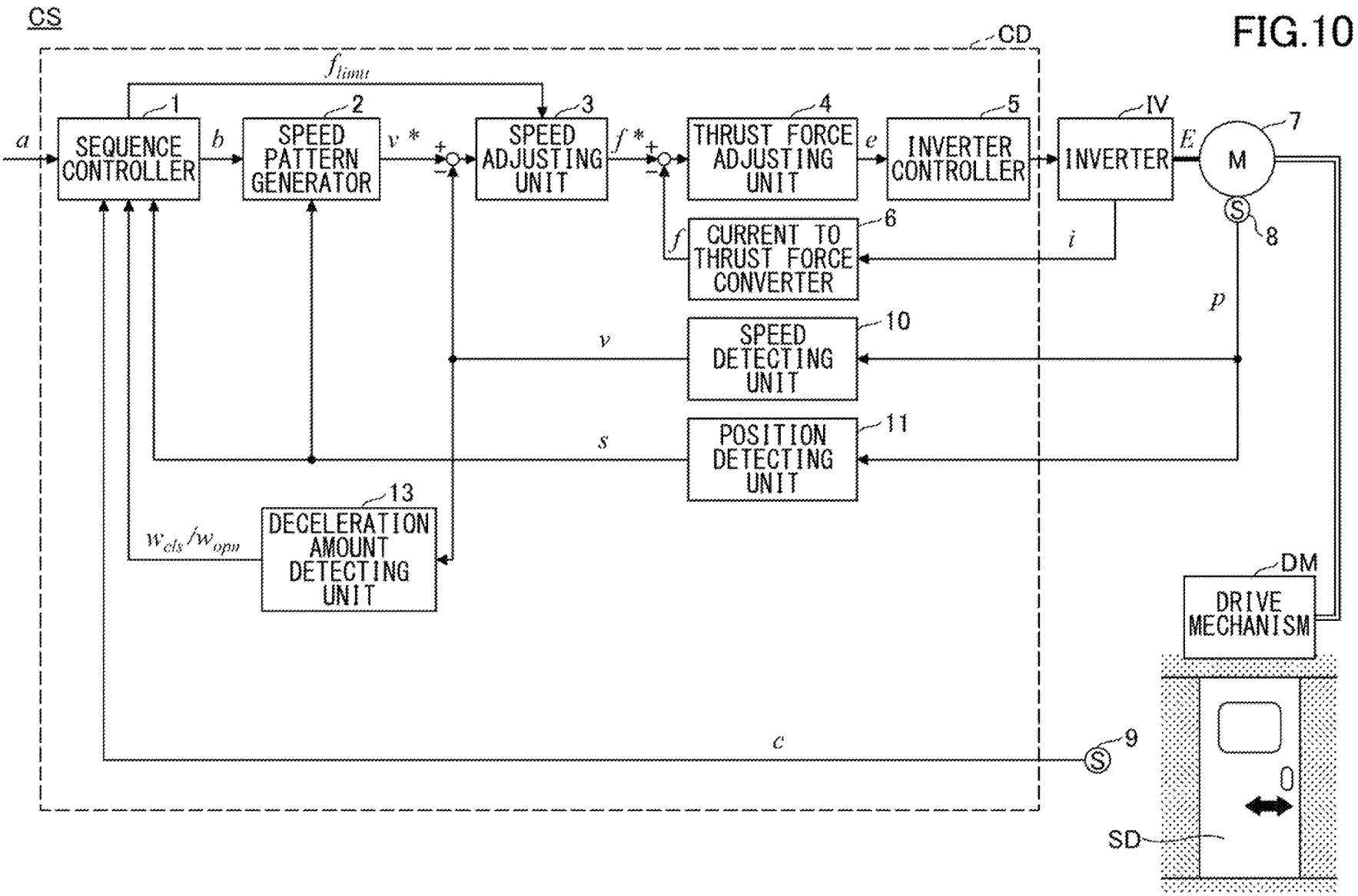
FIG. 10 is a control block diagram of a control system according to a second embodiment.

Next, with reference to FIG. 10, a control system CS of a second embodiment will be described. FIG. 10 is a control block diagram illustrating the control system CS of the second embodiment. The control system CS illustrated in FIG. 10 differs from the control system CS illustrated in FIG. 8A in that the control system CS includes a deceleration amount detecting unit 13 instead of the displacement amount detecting unit 12 illustrated in FIG. 8A. However, the control system CS illustrated in FIG. 10 and the control system CS illustrated in FIG. 8A have other features in common. Thus, in the following, the description of the common component will be omitted and the differences will be described in detail. Here, in the control system CS illustrated in FIG. 10, the DC chopper controller 5A may be adopted instead of the inverter controller 5, the DC chopper CP may be adopted instead of the inverter IV, and the DC electric motor may be adopted as the rotary motor 7 instead of the AC electric motor, as in the control system CS illustrated in FIG. 8B. The same applies to other control systems CS described below.

The deceleration amount detecting unit 13 is configured to detect the deceleration amount of the end door SD. Specifically, the deceleration amount detecting unit 13 is configured to detect the deceleration amount of the end door SD based on the actual speed value v. More specifically, the deceleration amount detecting unit 13 detects the deceleration amount of the end door SD in a time period between the first time point and the second time point based on a difference between the actual speed value v detected at the first time point and the actual speed value v detected at the second time point.

Further, the deceleration amount detecting unit 13 determines whether the end door SD is being manually opened by a person or opened by a non-human external force based on the deceleration amount of the end door SD.

Figure 11:
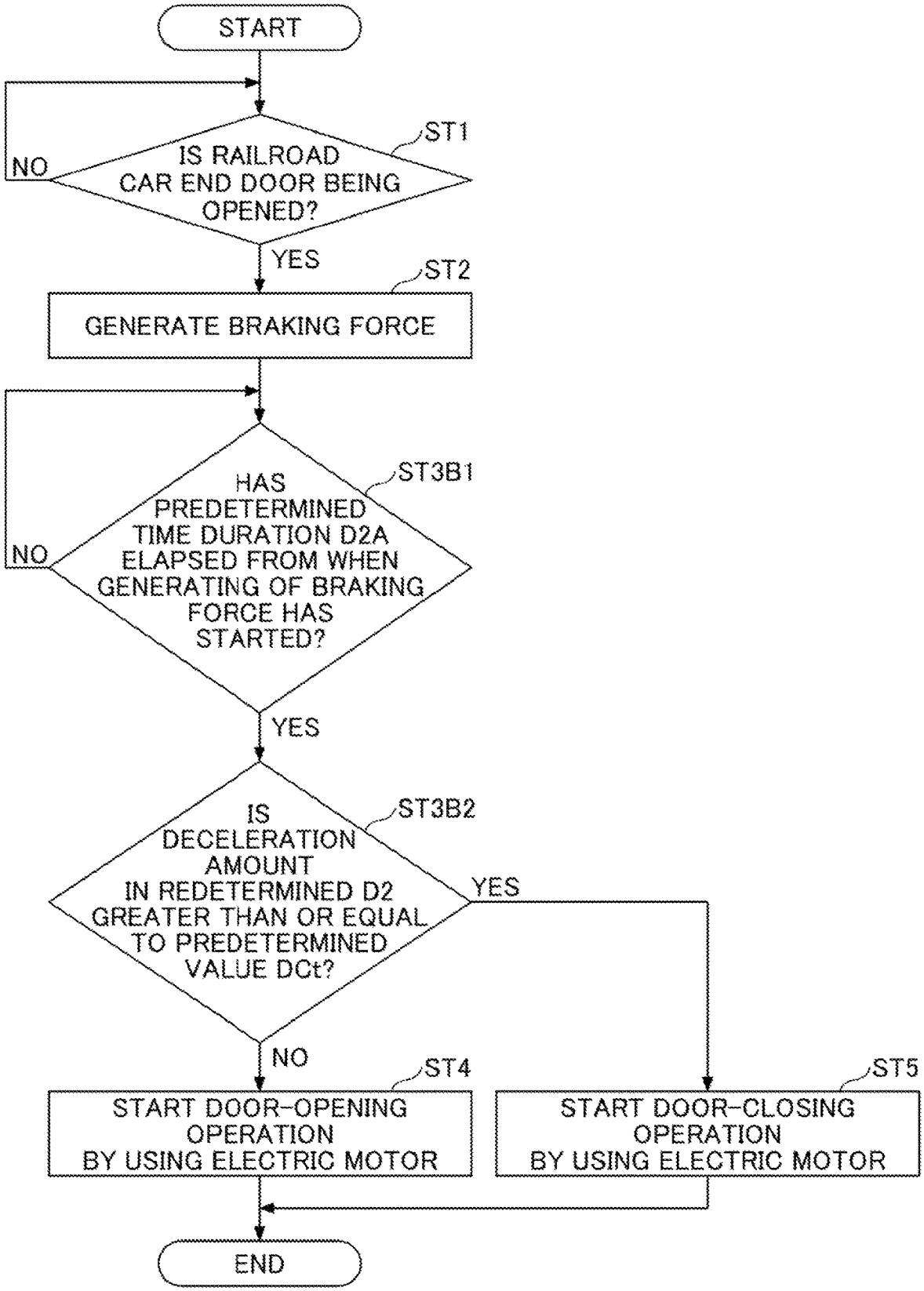
FIG. 11 is a flowchart of an assist process performed by the control system according to the second embodiment.

Next, with reference to FIG. 11, an assistant process performed in the control system CS of the second embodiment will be described. FIG. 11 is a flowchart of the assist process performed in the control system CS of the second embodiment. The flowchart illustrated in FIG. 11 differs from the flowchart illustrated in FIG. 2 in that the flowchart includes step ST3B1 and step ST3B2 representing specific contents of step ST3 illustrated in FIG. 2. However, the flowchart illustrated in FIG. 2 and the flowchart illustrated in FIG. 11 have other features in common. Thus, in the following, the description of the common components will be omitted and the differences will be described in detail.

In step ST3B1, after the generation of the braking force has started, the deceleration amount detecting unit 13 determines whether a predetermined time period D2A (see FIG. 4) has elapsed from when the generation of the braking force has started.

Figure 4:
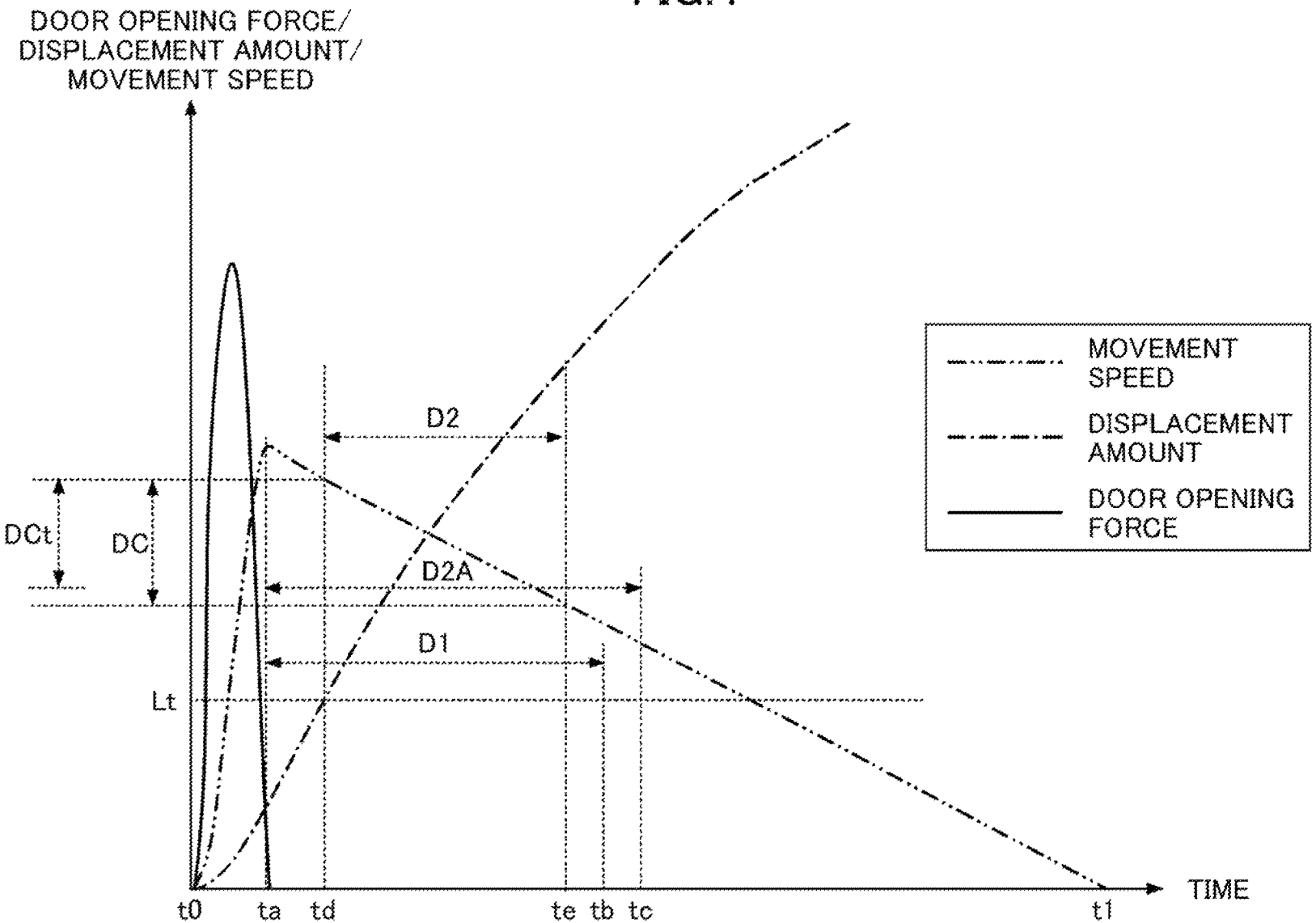
FIG. 4 is a drawing illustrating changes of a door opening force of the railroad car end door, the amount of movement of the railroad car end door, and the speed of movement of the railroad car end door.

If the deceleration amount detecting unit 13 determines that the predetermined time period D2A has elapsed from when the generation of the braking force has started (YES in step ST3B1), in step ST3B2, the deceleration amount detecting unit 13 determines whether a deceleration amount DC (see FIG. 4) in the predetermined time period D2 (see FIG. 4) is greater than or equal to the predetermined value DCt (see FIG. 4). The deceleration amount detecting unit 13 may determine whether the end door SD is stopped.

The predetermined time period D2 may, for example, be from a time td when it is determined that the displacement amount of the end door SD reaches the predetermined value Lt, or may be from a time when a predetermined time period has elapsed after it is determined that the end door SD is being opened.

If the deceleration amount detecting unit 13 determines that the deceleration amount DC is less than the predetermined value DCt (NO in step ST3B2), the deceleration amount detecting unit 13 determines that the end door SD is being manually opened by a person. In this case, in step ST4, the deceleration amount detecting unit 13 starts the door-opening operation by using the electric motor MR. Specifically, the deceleration amount detecting unit 13 outputs the control command $w_{opn}$ to the sequence controller 1. The sequence controller 1 starts the door-opening operation in response to receiving the control command $w_{opn}$ so that the end door SD is opened by the electric power. That is, the deceleration amount detecting unit 13 continues to move the end door SD being manually opened by a person in the opening direction by using the electric power. A case in which the deceleration amount DC is less than the predetermined value DCt includes a case in which the end door SD is accelerating.

If the deceleration amount detecting unit 13 determines that the deceleration amount DC is greater than or equal to the predetermined value DCt (YES in step ST3B2), the deceleration amount detecting unit 13 determines that the end door SD is being opened by a non-human external force. The kinetic behavior of the end door SD illustrated in FIG. 4 corresponds to this case. The deceleration amount detecting unit 13 may similarly determine that the end door SD is being opened by a non-human external force even when the deceleration amount detecting unit 13 determines that the end door SD is stopped. In this case, in step ST5, the deceleration amount detecting unit 13 starts the door-closing operation by using the electric motor MR. Specifically, the deceleration amount detecting unit 13 outputs the control command $w_{cls}$ to the sequence controller 1. The sequence controller 1 starts the closing door operation in response to receiving the control command $w_{cls}$ so that the end door SD being opened by a non-human external force is closed by the electric power.

The deceleration amount detecting unit 13 is configured to evaluate a deceleration state of the end door SD based on a difference (i.e., a change amount) of the movement speeds of the end door SD at two time points between which a time period is a certain time period (i.e., a predetermined time period D2). Therefore, the deceleration amount detecting unit 13 can avoid the influence of instantaneous changes in the movement speed of the end door SD caused by a vibrating external force, an unstable human force, or the like. That is, the deceleration amount detecting unit 13 can prevent an erroneous determination.

Specifically, as illustrated in FIG. 4, when the door opening force applied to the end door SD, the displacement amount of the end door SD, and the movement speed of the end door SD change, the sequence controller 1 detects that the end door SD is being opened at the time to and generates the braking force.

When the deceleration amount detecting unit 13 determines at time tc that the predetermined time period D2A has elapsed from when the generation of the braking force has started, the deceleration amount detecting unit 13 determines that the deceleration amount DC in the predetermined time period D2 is greater than or equal to the predetermined value DCt, and determines that the end door SD is being opened by a non-human external force. The deceleration amount DC is a difference between the movement speed of the end door SD at the time td and the movement speed of the end door SD at the time te. In this case, the deceleration amount detecting unit 13 outputs the control command $w_{cls}$ to the sequence controller 1. The sequence controller 1 starts the closing door operation in response to receiving the control command $w_{cls}$ so that the end door SD being opened by a non-human external force is closed by the electric power.

Figure 12:
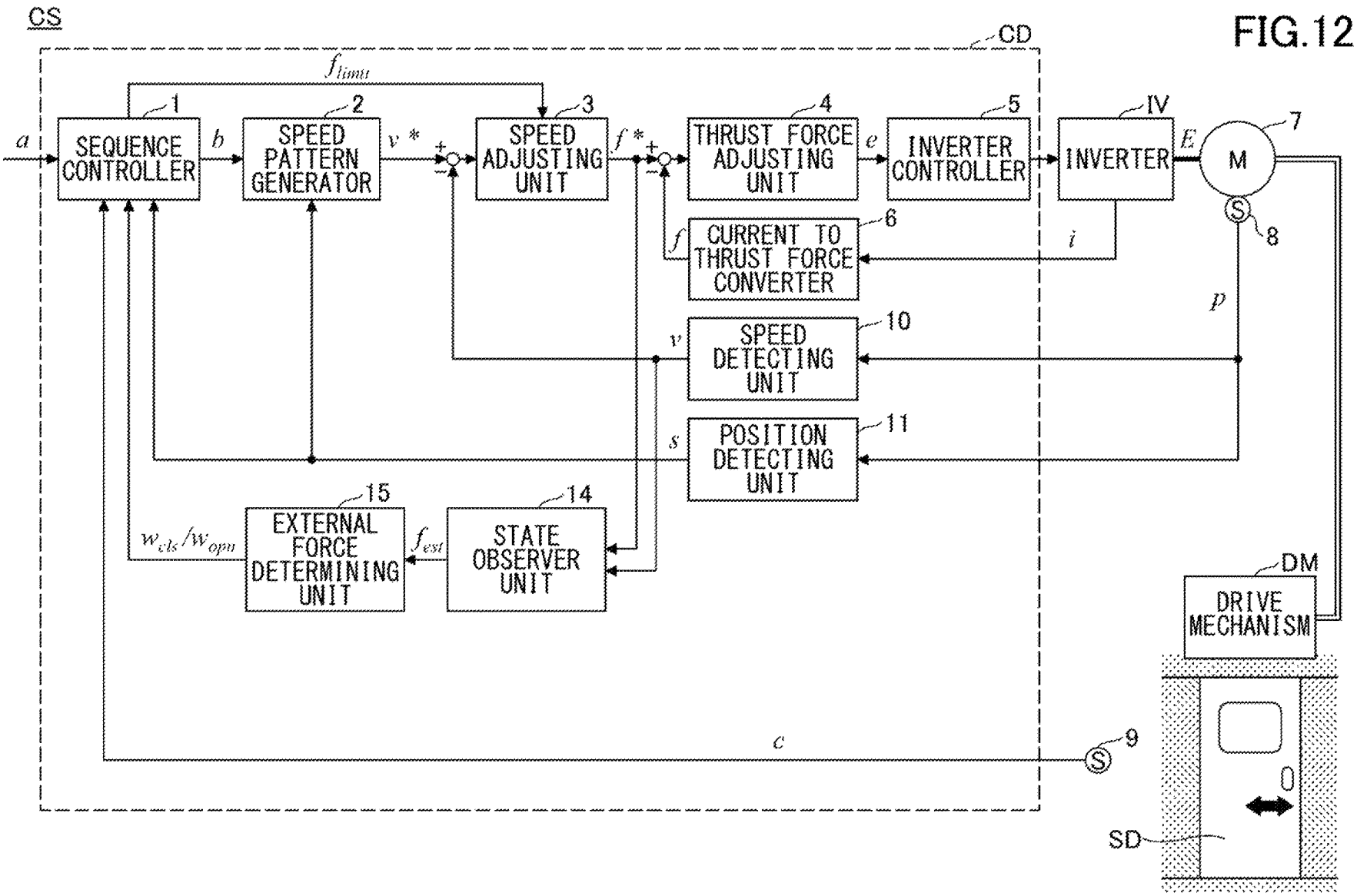
FIG. 12 is a control block diagram of a control system according to a third embodiment.

Next, a control system CS of a third embodiment will be described with reference to FIG. 12. FIG. 12 is a control block diagram of the control system CS of the third embodiment. The control system CS illustrated in FIG. 12 differs from the control system CS illustrated in FIG. 8A in that the control system CS includes a state observer unit 14 and an external force determining unit 15 are provided instead of the displacement amount detecting unit 12 illustrated in FIG. 8A. However, the control system CS illustrated in FIG. 12 and the control system CS illustrated in FIG. 8A have other features in common. Thus, in the following, the description of the common components will be omitted and the differences will be described in detail.

The state observer unit 14 is configured to estimate the external force acting on the end door SD based on the state observer theory. Specifically, the state observer unit 14 calculates the force acting on the rotating shaft of the rotary motor 7 based on the actual speed value v and the thrust force command value f* as an estimated external force value $f_{est}$, which is an estimated value of an external force acting on the end door SD. The state observer unit 14 may calculate the force acting on the rotating shaft of the rotary motor 7 based on the actual speed value v and the actual thrust force value f as the estimated external force value $f_{est}$. Various methods that achieves the state observer unit, such as Luenberger's observer unit, a state feedback system based on an inverse system, and a minimum-dimensional observer, have been practically used. The state observer unit 14 may be achieved based on any method. Because the method that achieves the state observer unit is a publicly known technique, the detailed description will be omitted.

The external force determining unit 15 is configured to determine whether the end door SD is being manually opened by a person, based on the external force acting on the end door SD. Specifically, the external force determining unit 15 determines whether the end door SD is being manually opened by a person, based on the estimated external force value $f_{est}$ output by the state observer unit 14.

Figure 13:
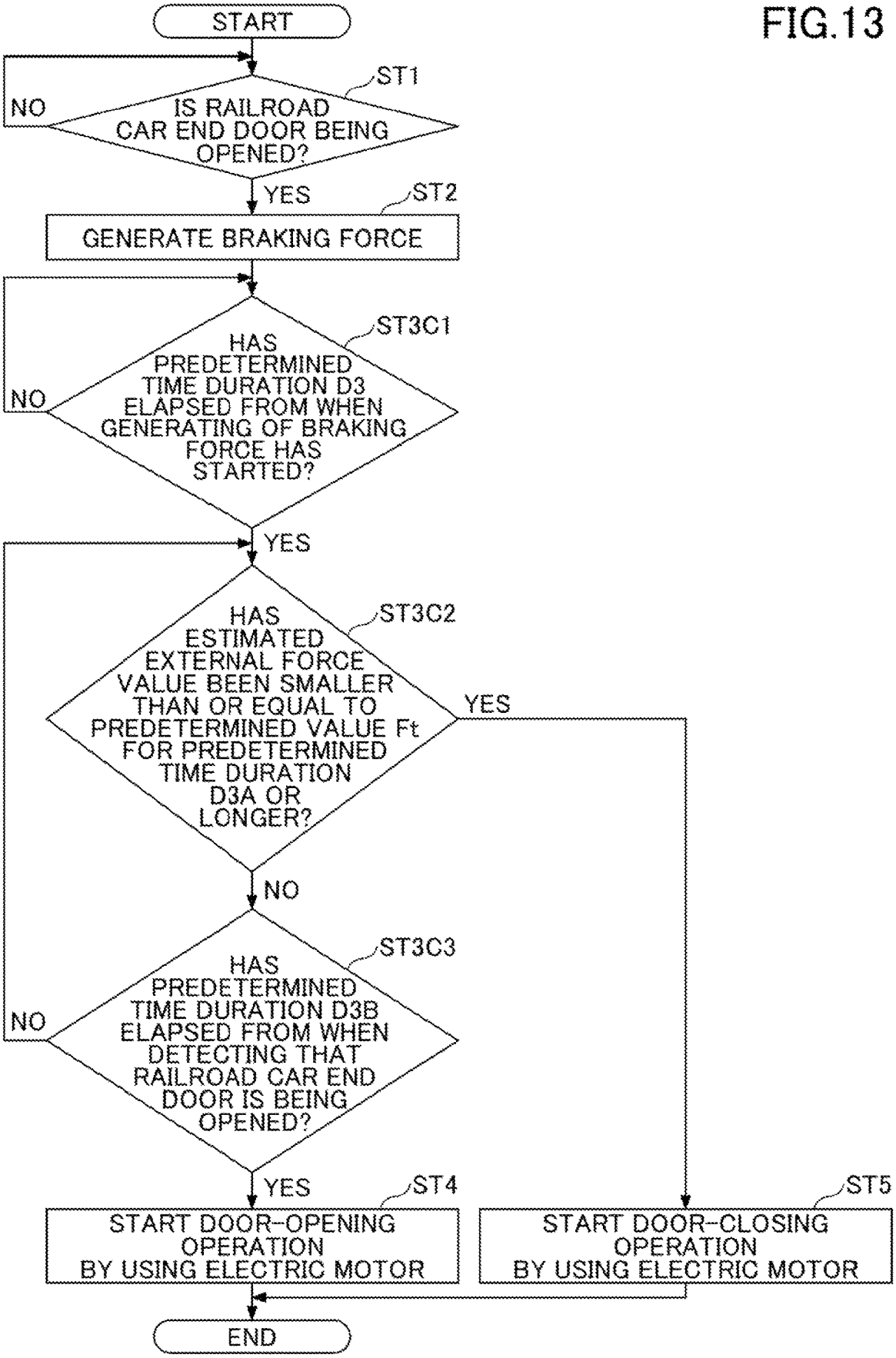
FIG. 13 is a flowchart of an assist process performed by the control system according to the third embodiment.

Next, with reference to FIG. 13, an assist process performed in the control system CS of the third embodiment will be described. FIG. 13 is a flowchart of the assist process performed in the control system CS of the third embodiment. The flowchart illustrated in FIG. 13 differs from the flowchart illustrated in FIG. 2 in that the flowchart includes steps ST3C1 to ST3C3 representing specific contents of step ST3 illustrated in FIG. 2. However, the flowchart illustrated in FIG. 2 and the flowchart illustrated in FIG. 13 have other features in common. Thus, in the following, the description of the common components will be omitted and the differences will be described in detail.

In step ST3C1, after the generation of the braking force has started, the external force determining unit 15 determines whether the predetermined time period D3 (see FIG. 6) has elapsed from when the generation of the braking force has started.

If the external force determining unit 15 determines that the predetermined time period D3 has elapsed from when the generation of the braking force has started (YES in step ST3C1), in step ST3C2, the external force determining unit 15 determines whether the estimated external force value $f_{est}$ has been smaller than or equal to the predetermined value Ft for a predetermined time period D3A from then.

If the external force determining unit 15 determines that the estimated external force value $f_{est}$ has not been smaller than or equal to the predetermined value Ft for the predetermined time period D3A or longer (NO in step ST3C2), in step ST3C3, the external force determining unit 15 determines whether a predetermined time period D3B has elapsed from when it is detected that the end door SD is being opened.

Then, if the external force determining unit 15 determines that the predetermined time period D3B has elapsed from when it is detected that the end door SD is being opened (YES in step ST3C3), the external force determining unit 15 determines that the end door SD is being manually opened by a person. In this case, in step ST4, the external force determining unit 15 starts the door-opening operation by using the electric motor MR. Specifically, the external force determining unit 15 outputs the control command $w_{opn}$ to the sequence controller 1. The sequence controller 1 starts the door-opening operation in response to receiving the control command $w_{opn}$ so that the end door SD is opened by the electric power. That is, the external force determining unit 15 continues to move the end door SD being manually opened by a person by using the electric power in the opening direction.

As described above, if the estimated external force value $f_{est}$ does not become smaller than or equal to the predetermined value Ft even when the predetermined time period D3B has elapsed from when it is detected that the end door SD is being opened, the external force determining unit 15 determines that the end door SD is being manually opened by a person and starts the door-opening operation.

If the external force determining unit 15 determines that the estimated external force value $f_{est}$ has been smaller than or equal to the predetermined value Ft for the predetermined time period D3A or longer (YES in the step ST3C2), the external force determining unit 15 determines that the end door SD is being opened by a non-human external force. The kinetic behavior of the end door SD illustrated in FIG. 6 corresponds to this case. In this case, in step ST5, the external force determining unit 15 starts the door-closing operation by using the electric motor MR. Specifically, the external force determining unit 15 outputs the control command $w_{cls}$ to the sequence controller 1. The sequence controller 1 starts the door-closing operation in response to receiving the control command $w_{cls}$ so that the end door SD being opened by a non-human external force is closed by the electric power.

Figure 6:
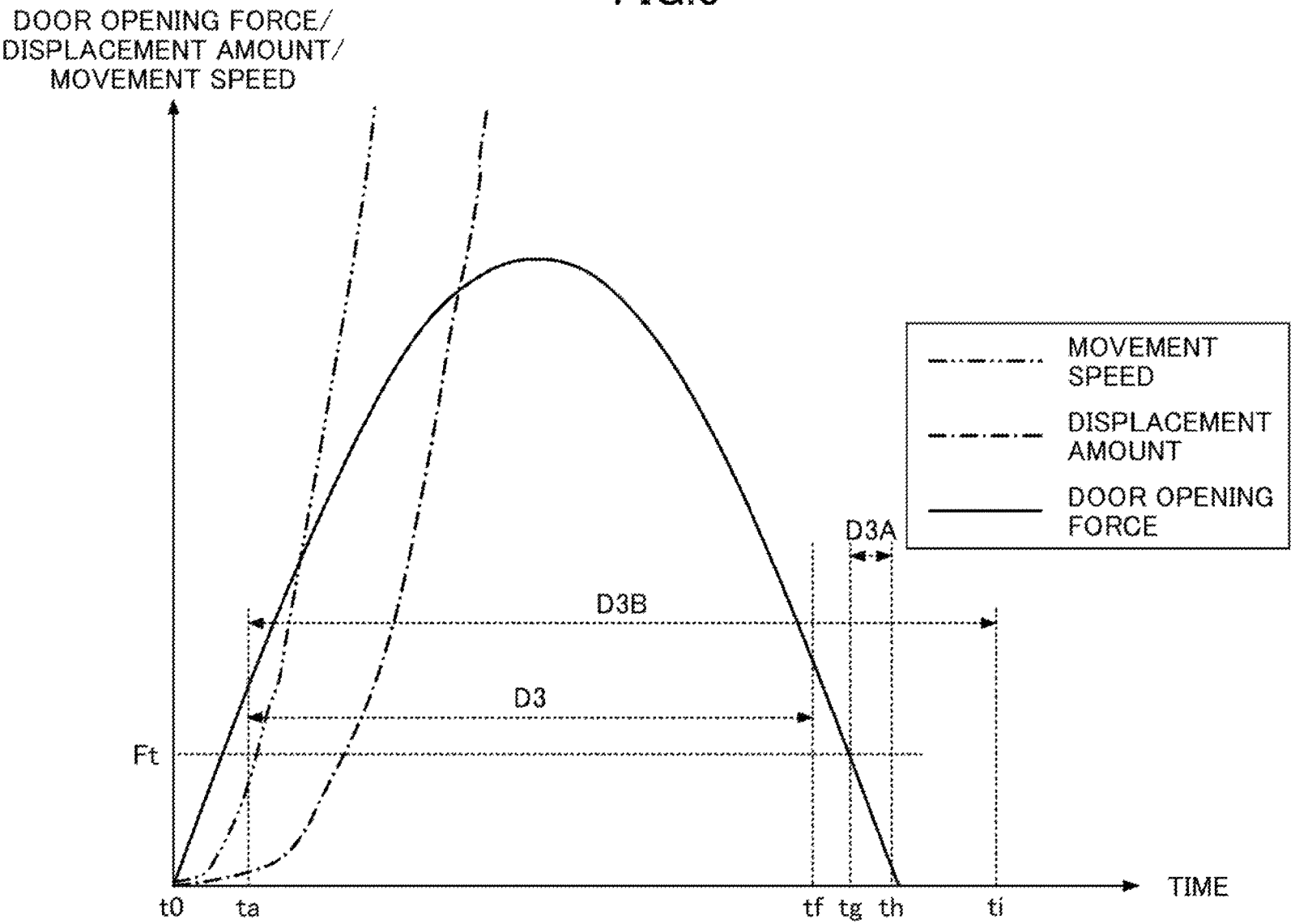
FIG. 6 is a drawing illustrating changes of a door opening force of the railroad car end door, the amount of movement of the railroad car end door, and the speed of movement of the railroad car end door.

Specifically, as illustrated in FIG. 6, when the door opening force applied to the end door SD, the displacement amount of the end door SD, and the movement speed of the end door SD change, the sequence controller 1 detects that the end door SD is being opened at the time ta, and generates the braking force.

Then, when the external force determining unit 15 determines at the time tf that the predetermined time period D3 has elapsed from when the generation of the braking force has started, the external force determining unit 15 starts monitoring changes of the estimated external force value $f_{est}$. In the example illustrated in FIG. 6, the changes of the estimated external force value $f_{est}$ correspond to changes of the door opening force. The external force determining unit 15 detects at the time tg that the estimated external force value $f_{est}$ is smaller than or equal to the predetermined value Ft and further determines at the time th that the estimated external force value $f_{est}$ has been smaller than or equal to the predetermined value Ft for the predetermined time period D3A or longer. Then, the external force determining unit 15 determines whether a predetermined time period D3B has elapsed from when it is detected that the end door SD is being opened at the time ta. At the time th, the elapsed time from the time ta when it is detected that the end door SD is being opened does not reach the predetermined time period D3B. Subsequently, at the time ti, the external force determining unit 15 determines that the predetermined time period D3B has elapsed from the time ta when it is detected the end door SD is being opened, and determines that the end door SD is being opened by a non-human external force. In this case, the external force determining unit 15 outputs the control command $w_{cls}$ to the sequence controller 1. The sequence controller 1 starts the door-closing operation in response to receiving the control command we's so that the end door SD being opened by a non-human external force is closed by the electric power.

Figure 14:
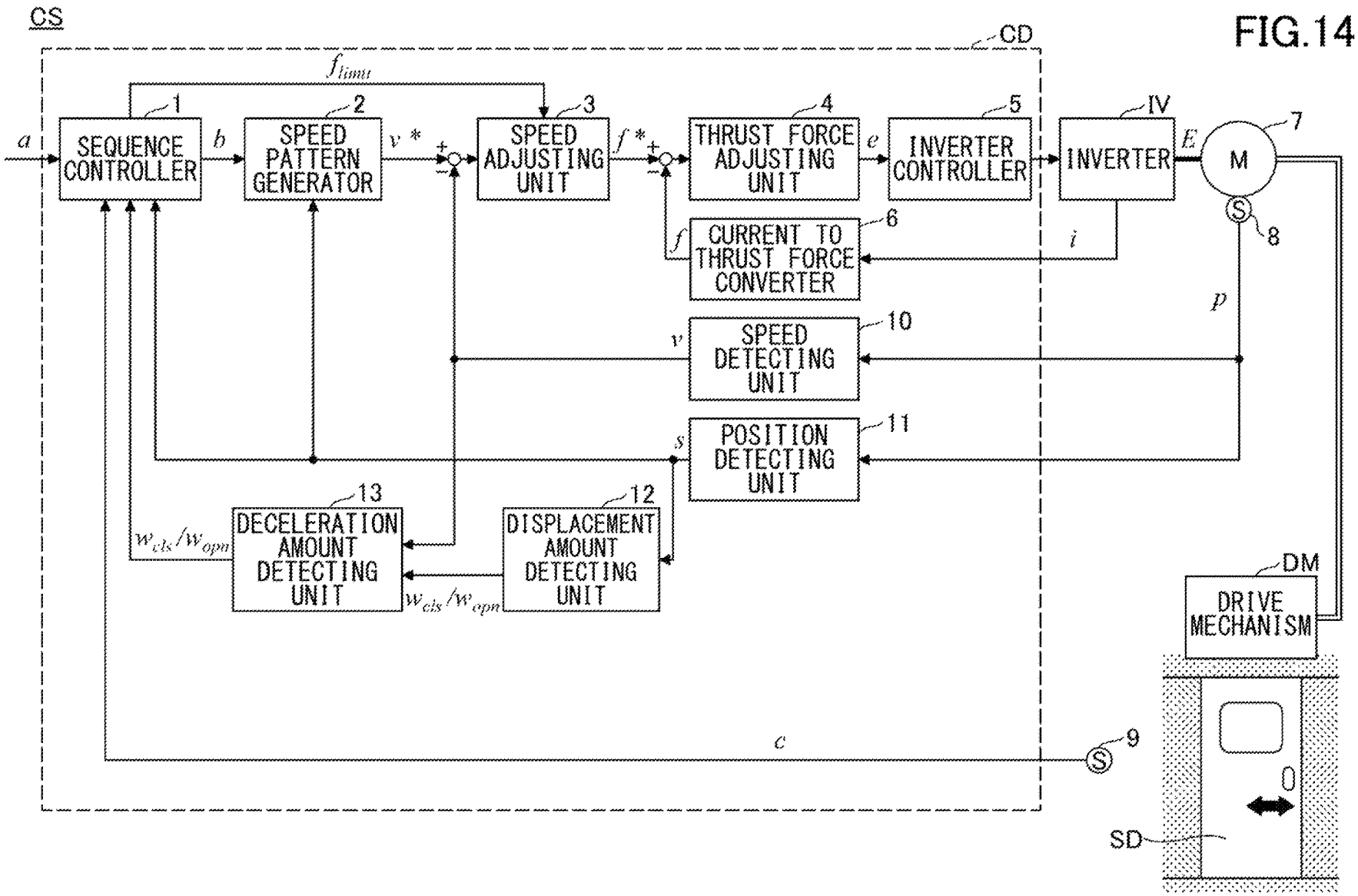
FIG. 14 is a control block diagram of a control system according to a fourth embodiment.

Next, with reference to FIG. 14, a control system CS of a fourth embodiment will be described. FIG. 14 is a control block diagram of the control system CS of the fourth embodiment. The control system CS illustrated in FIG. 14 differs from the control system CS illustrated in FIG. 8A in that the control system CS includes the deceleration amount detecting unit 13 at a subsequent stage of the displacement amount detecting unit 12 illustrated in FIG. 8A. However, the control system CS illustrated in FIG. 14 and the control system CS illustrated in FIG. 8A have other features in common. Thus, in the following, the description of the common components will be omitted and the differences will be described in detail.

The deceleration amount detecting unit 13 is configured to detect the deceleration amount of the end door SD. Specifically, the deceleration amount detecting unit 13 is configured to detect the deceleration amount of the end door SD based on the actual speed value v. More specifically, the deceleration amount detecting unit 13 detects the deceleration amount of the end door SD in a time period between the first time point and the second time point based on a difference between the actual speed value v detected at the first time point and the actual speed value v detected at the second time point.

The deceleration amount detecting unit 13 determines whether the end door SD is being manually opened by a person or by a non-human external force based on the deceleration amount of the end door SD and the control command $w_{opn}$ or the control command $w_{cls}$ output by the displacement amount detecting unit 12.

Figure 15:
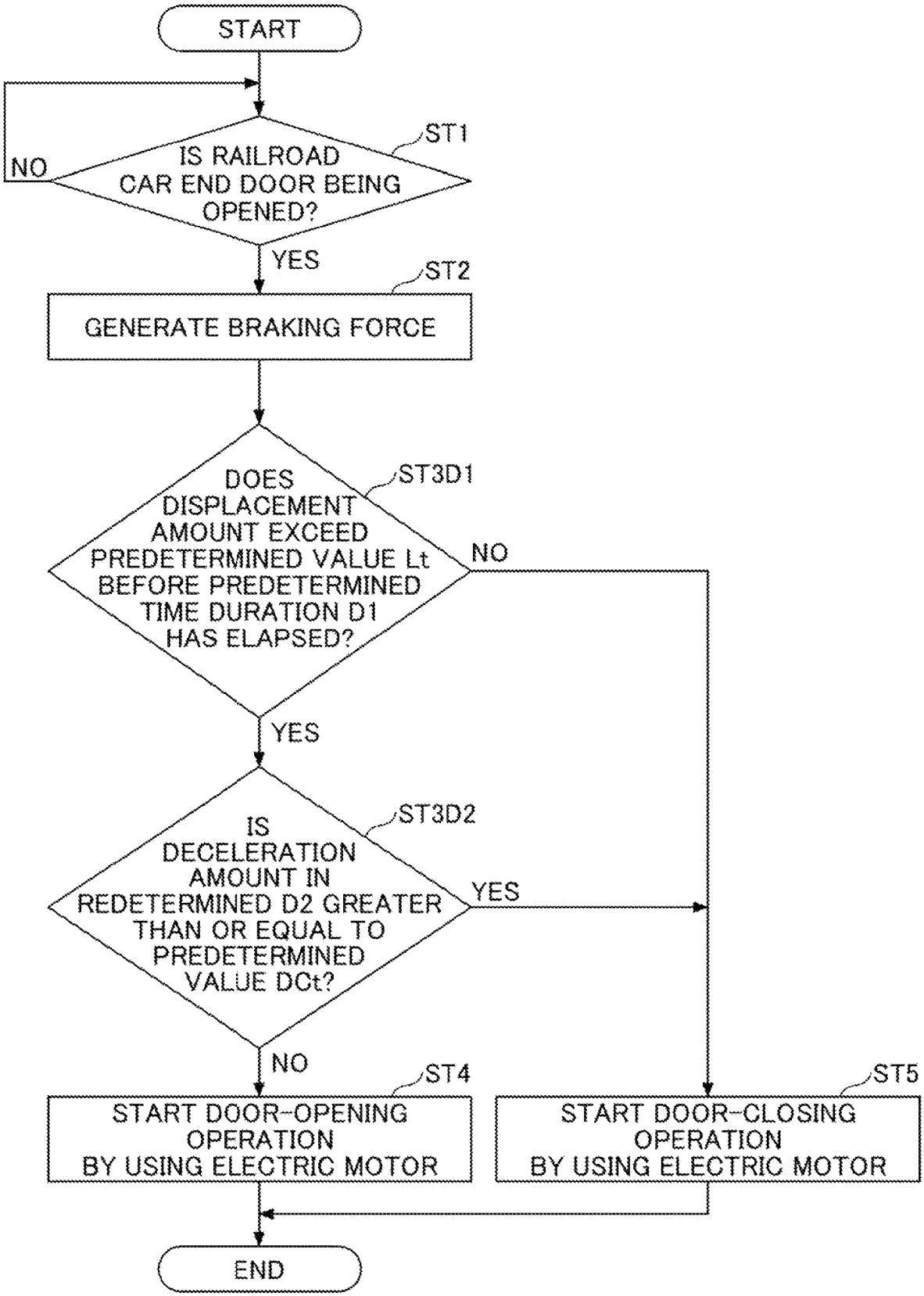
FIG. 15 is a flowchart of an assist process performed by the control system according to the fourth embodiment.

Next, with reference to FIG. 15, an assist process performed in the control system CS of the fourth embodiment will be described. FIG. 15 is a flowchart of the assist process performed in the control system CS of the fourth embodiment. The flowchart illustrated in FIG. 15 differs from the flowchart illustrated in FIG. 2 in that the flowchart includes step ST3D1 and step ST3D2 representing specific contents of step ST3 illustrated in FIG. 2. However, the flowchart illustrated in FIG. 2 and the flowchart illustrated in FIG. 15 have other features in common. Thus, in the following, the description of the common components will be omitted and the differences will be described in detail.

After the generation of the braking force has started, in step ST3D1, the displacement amount detecting unit 12 determines whether the displacement amount of the end door SD exceeds the predetermined value Lt (see FIG. 4) before the predetermined time period D1 (see FIG. 4) has elapsed after braking is started.

Then, if the displacement amount detecting unit 12 determines that the displacement amount of the end door SD exceeds the predetermined value Lt before the predetermined time period D1 has elapsed after braking is started (YES in step ST3D1), it is determined that the end door SD is being manually opened by a person. The kinetic behavior of the end door SD illustrated in FIG. 4 corresponds to this case. In this case, the displacement amount detecting unit 12 outputs the control command $w_{opn}$ to the deceleration amount detecting unit 13.

If the displacement amount detecting unit 12 determines that the displacement amount of the end door SD does not reach the predetermined value Lt even after the predetermined time period D1 has elapsed (NO in step ST3D1), the displacement amount detecting unit 12 determines that the end door SD is being opened by a non-human external force. The kinetic behavior of the end door SD illustrated in FIG. 3 corresponds to this case. In this case, the displacement amount detecting unit 12 outputs the control command $w_{cls}$ to the deceleration amount detecting unit 13.

Subsequently, if it is determined that the displacement amount of the end door SD exceeds the predetermined value Lt (YES in step ST3D1), in step ST3D2, the deceleration amount detecting unit 13 determines whether the deceleration amount DC (see FIG. 4) in the predetermined time period D2 (see FIG. 4) is greater than or equal to the predetermined value DCt (see FIG. 4). The deceleration amount detecting unit 13 may determine whether the end door SD is stopped. That is, if the displacement amount detecting unit 12 determines that the end door SD is being manually opened by a person, the deceleration amount detecting unit 13 determines whether the deceleration amount DC in the predetermined time period D2 is greater than or equal to the predetermined value DCt after the predetermined time period D2A has elapsed from when the generation of the braking force has started.

If the deceleration amount detecting unit 13 determines that the deceleration amount DC is less than the predetermined value DCt (NO in step ST3D2), the deceleration amount detecting unit 13 determines that the end door SD is being manually opened by a person. That is, if the displacement amount detecting unit 12 determines that the end door SD is being manually opened by a person and the deceleration amount detecting unit 13 determines that the deceleration amount DC is less than the predetermined value DCt, the deceleration amount detecting unit 13 ultimately determines that the end door SD is being manually opened by a person. In this case, in step ST4, the deceleration amount detecting unit 13 starts the door-opening operation by using the electric motor MR. Specifically, the deceleration amount detecting unit 13 outputs the control command $w_{opn}$ to the sequence controller 1. The sequence controller 1 starts the door-opening operation in response to receiving the control command $w_{opn}$ so that the end door SD is opened by the electric power. That is, the deceleration amount detecting unit 13 continues to move the end door SD being manually opened by a person in the opening direction by using the electric power. A case in which the deceleration amount DC is less than the predetermined value DCt includes a case in which the end door SD is accelerating.

If the deceleration amount detecting unit 13 determines that the deceleration amount DC is greater than or equal to the predetermined value DCt (YES in step ST3D2), the deceleration amount detecting unit 13 determines that the end door SD is being opened by a non-human external force. The kinetic behavior of the end door SD illustrated in FIG. 4 corresponds to this case. Similarly, even if the deceleration amount detecting unit 13 determines that the end door SD is stopped, the deceleration amount detecting unit 13 may determine that the end door SD is being opened by a non-human external force. That is, even if the displacement amount detecting unit 12 determines that the end door SD is being manually opened by a person, if the deceleration amount detecting unit 13 determines that the deceleration amount DC is greater than or equal to the predetermined value DCt or if the deceleration amount detecting unit 13 determines that the end door SD is stopped, the deceleration amount detecting unit 13 ultimately determines that the end door SD is being opened by a non-human external force.

If it is determined that the displacement amount of the end door SD does not exceed the predetermined value Lt (NO in step ST3D1), the deceleration amount detecting unit 13 ultimately determines that the end door SD is being opened by a non-human external force without determining whether the deceleration amount DC in the predetermined time period D2 is greater than or equal to the predetermined value DCt. That is, if the displacement amount detecting unit 12 determines that the end door SD is being opened by a non-human external force, the deceleration amount detecting unit 13 ultimately determines that the end door SD is being opened by a non-human external force without determining whether the deceleration amount DC in the predetermined time period D2 is greater than or equal to the predetermined value DCt. The kinetic behavior of the end door SD illustrated in FIG. 3 corresponds to this case.

If it is ultimately determined that the end door SD is being opened by a non-human external force, in step ST5, the deceleration amount detecting unit 13 starts the door-closing operation by using the electric motor MR. Specifically, the deceleration amount detecting unit 13 outputs the control command $w_{cls}$ is to the sequence controller 1. The sequence controller 1 starts the door-closing operation in response to receiving the control command $w_{cls}$ so that the end door SD being opened by a non-human external force is closed by the electric power.

Specifically, as illustrated in FIG. 4, when the door opening force applied to the end door SD, the displacement amount of the end door SD, and the movement speed of the end door SD change, the sequence controller 1 detects that the end door SD is being opened at the time ta and generates a braking force.

Then, the displacement amount detecting unit 12 determines at the time ta that the displacement amount of the end door SD exceeds the predetermined value Lt before the predetermined time period D1 has elapsed. In this case, the displacement amount detecting unit 12 determines that the end door SD is being manually opened by a person and outputs the control command $w_{opn}$ to the deceleration amount detecting unit 13.

However, even if the displacement amount detecting unit 12 outputs the control command $w_{opn}$, if the deceleration amount detecting unit 13 determines that the predetermined time period D2A has elapsed at the time tc and that the deceleration amount DC in the predetermined time period D2 is greater than or equal to the predetermined value DCt, the deceleration amount detecting unit 13 ultimately determines that the end door SD is being opened by a non-human external force. That is, even if the displacement amount detecting unit 12 determines that the end door SD is being manually opened by a person, the deceleration amount detecting unit 13 ultimately determines that the end door SD is being opened by a non-human external force. In this case, the deceleration amount detecting unit 13 outputs the control command $w_{cls}$ to the sequence controller 1. The sequence controller 1 starts the door-closing operation in response to receiving the control command $w_{cls}$ so that the end door SD being opened by a non-human external force is closed by the electric power.

Figure 16:
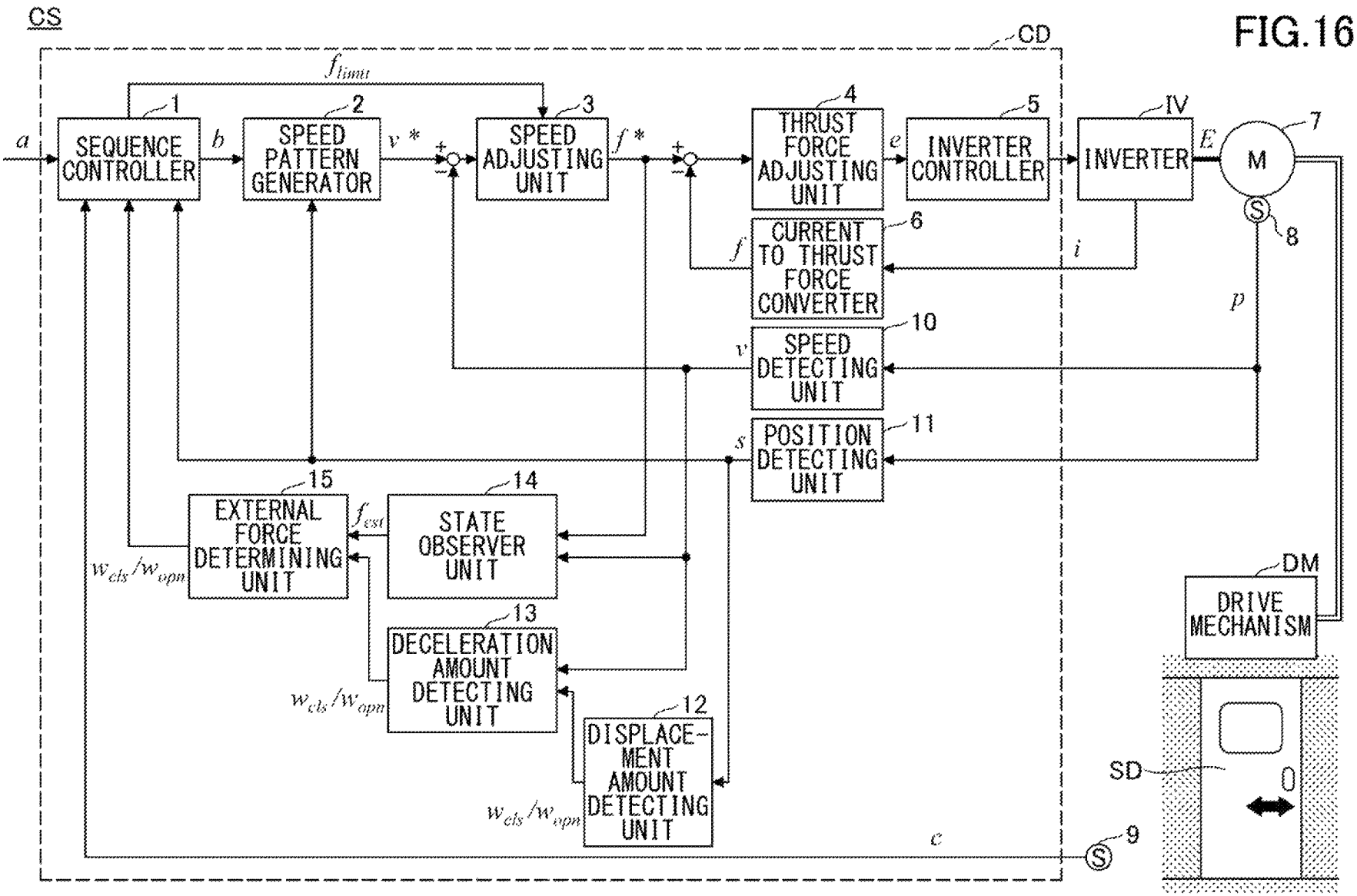
FIG. 16 is a control block diagram of a control system according to a fifth embodiment.

Next, with reference to FIG. 16, a control system CS of a fifth embodiment will be described. FIG. 16 is a control block diagram of the control system CS of the fifth embodiment. The control system CS illustrated in FIG. 16 differs from the control system CS illustrated in FIG. 8A in that the control system CS includes the deceleration amount detecting unit 13, the state observer unit 14, and the external force determining unit 15 at a subsequent stage of the displacement amount detecting unit 12 illustrated in FIG. 8A. However, the control system CS illustrated in FIG. 16 and the control system CS illustrated in FIG. 8A have other features in common. Thus, in the following, the description of the common components will be omitted and the differences will be described in detail.

The deceleration amount detecting unit 13 is configured to detect the deceleration amount of the end door SD. Specifically, the deceleration amount detecting unit 13 is configured to detect the deceleration amount of the end door SD based on the actual speed value v.

The deceleration amount detecting unit 13 determines whether the end door SD is being manually opened by a person or opened by a non-human external force based on the deceleration amount of the end door SD and the control command $w_{opn}$ or the control command $w_{cls}$ output by the displacement amount detecting unit 12.

The state observer unit 14 is configured to estimate the external force acting on the end door SD based on the state observer theory. Specifically, the state observer unit 14 calculates the force acting on the rotation shaft of the rotary motor 7 based on the actual speed value v and the thrust force command value f* as the estimated external force value $f_{est}$, which is an estimated value of the external force acting on the end door SD.

The external force determining unit 15 is configured to determine whether the end door SD is being manually opened by a person based on the external force acting on the end door SD. Specifically, the external force determining unit as determines whether the end door SD is being manually opened by a person based on the estimated external force value $f_{est}$ output by the state observer unit 14.

The external force determining unit 15 determines whether the end door SD is being manually opened by a person or opened by a non-human external force based on the estimated external force value $f_{est}$ and the control command $w_{opn}$ or the control command $w_{cls}$ output by the deceleration amount detecting unit 13.

Figure 17:
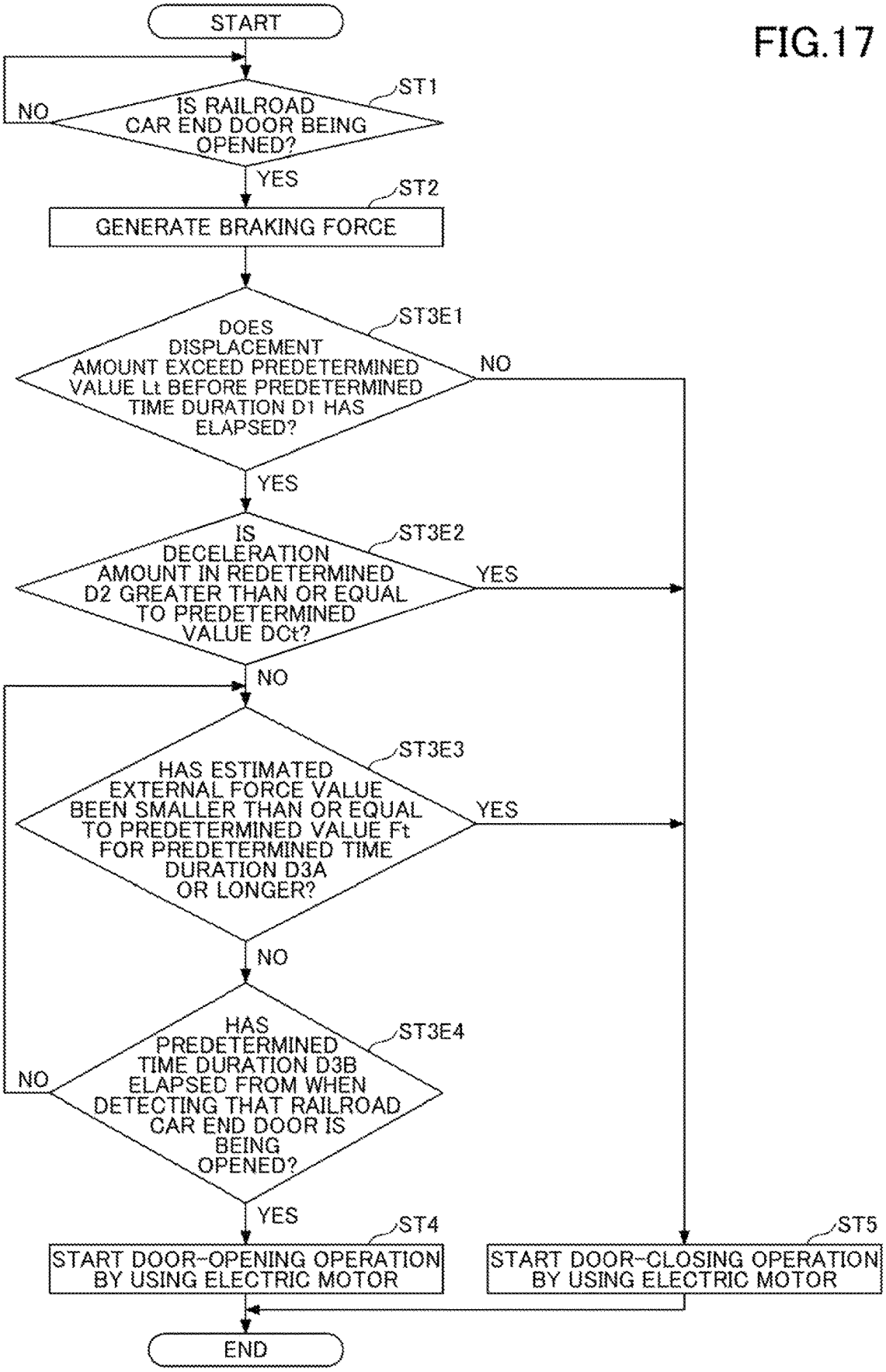
FIG. 17 is a flowchart of an assist process performed by the control system according to the fifth embodiment.

Next, with reference to FIG. 17, an assist process performed in the control system CS of the fifth embodiment will be described. FIG. 17 is a flowchart of the assist process performed in the control system CS of the fifth embodiment. The flowchart illustrated in FIG. 17 differs from the flowchart illustrated in FIG. 2 in that the flowchart includes steps ST3E1 to ST3E4 representing specific contents of step ST3 illustrated in FIG. 2. However, the flowchart illustrated in FIG. 2 and the flowchart illustrated in FIG. 17 have other features in common. Thus, in the following, the description of the common components will be omitted and the differences will be described in detail.

After the generation of the braking force has started, in step ST3E1, the displacement amount detecting unit 12 determines whether the displacement amount of the end door SD exceeds the predetermined value Lt (see FIG. 5) before the predetermined time period D1 (see FIG. 5) has elapsed from the start of braking.

Then, if it is determined that the displacement amount of the end door SD exceeds the predetermined value Lt (YES in step ST3E1) after braking is started before the predetermined time period D1 has elapsed, the displacement amount detecting unit 12 determines that the end door SD is being manually opened by a person. The kinetic behavior of the end door SD illustrated in FIG. 5 corresponds to this case. In this case, the displacement amount detecting unit 12 outputs the control command $w_{opn}$ to the deceleration amount detecting unit 13.

If it is determined that the displacement amount of the end door SD has not reached the predetermined value Lt even after the predetermined time period D1 (NO in step ST3E1), the displacement amount detecting unit 12 determines that the end door SD is being opened by a non-human external force. The kinetic behavior of the end door SD illustrated in FIG. 3 corresponds to this case. In this case, the displacement amount detecting unit 12 outputs the control command $w_{cls}$ to the deceleration amount detecting unit 13.

Subsequently, when if it is determined that the displacement amount of the end door SD exceeds the predetermined value Lt (YES in Step ST3E1), in step ST3E2, the deceleration amount detecting unit 13 determines whether the deceleration amount DC (see FIG. 5) in the predetermined time period D2 (see FIG. 5) is greater than or equal to the predetermined value DCt (see FIG. 5). The deceleration amount detecting unit 13 may determine whether the end door SD is stopped. That is, if the displacement amount detecting unit 12 determines that the end door SD is being manually opened by a person, the deceleration amount detecting unit 13 determines whether the deceleration amount DC in the predetermined time period D2 is greater than or equal to the predetermined value DCt after the predetermined time period D2A has elapsed from when the generation of the braking force has started.

If the deceleration amount detecting unit 13 determines that the deceleration amount DC is greater than or equal to the predetermined value DCt (YES in step ST3E2), the deceleration amount detecting unit 13 determines that the end door SD is being opened by a non-human external force. The kinetic behavior of the end door SD illustrated in FIG. 4 corresponds to this case. Similarly, if the deceleration amount detecting unit 13 determines that the end door SD is stopped, the deceleration amount detecting unit 13 may determine that the end door SD is being opened by a non-human external force. That is, even if the displacement amount detecting unit 12 determines that the end door SD is being manually opened by a person, if the deceleration amount detecting unit 13 determines that the deceleration amount DC is greater than or equal to the predetermined value DCt or if the deceleration amount detecting unit 13 determines that the end door SD is stopped, the deceleration amount detecting unit 13 determines that the end door SD is being opened by a non-human external force. In this case, the deceleration amount detecting unit 13 outputs the control command $w_{cls}$ to the external force determining unit 15.

If the deceleration amount detecting unit 13 determines that the deceleration amount DC is less than the predetermined value DCt (NO in step ST3E2), the deceleration amount detecting unit 13 determines that the end door SD is being manually opened by a person. That is, if the displacement amount detecting unit 12 determines that the end door SD is being manually opened by a person and the deceleration amount detecting unit 13 determines that the deceleration amount DC is less than the predetermined value DCt, the deceleration amount detecting unit 13 determines the end door SD is being manually opened by a person. A case in which the deceleration amount DC is less than the predetermined value DCt includes a case in which the end door SD is accelerating. The kinetic behavior of the end door SD illustrated in FIG. 5 corresponds to this case. In this case, the deceleration amount detecting unit 13 outputs the control command $w_{opn}$ to the external force determining unit 15.

Then, if it is determined that the deceleration amount DC is less than the predetermined value DCt (NO in step ST3E2), in step ST3E3, the external force determining unit 15 determines whether the estimated external force value $f_{est}$ has been smaller than or equal to the predetermined value Ft for the predetermined time period D3A or longer. That is, if the deceleration amount detecting unit 13 determines that the end door SD is being manually opened by a person, the external force determining unit 15 determines whether the estimated external force value $f_{est}$ has been smaller than or equal to the predetermined value Ft for the predetermined time period D3A or longer after determining that the predetermined time period D3 (see FIG. 5) has elapsed from when the generation of the braking force has started.

If the external force determining unit 15 determines that the estimated external force value $f_{est}$ has not been smaller than or equal to the predetermined value Ft for the predetermined time period D3A or greater (NO in step ST3E3), in step ST3E4, the external force determining unit 15 determines whether the predetermined time period D3B has elapsed from when detecting that the end door SD is being opened.

Then, if the external force determining unit 15 determines that the predetermined time period D3B has elapsed from when detecting that the end door SD is being opened (YES in step ST3E4), the external force determining unit 15 ultimately determines that the end door SD is being manually opened by a person. In this case, in step ST4, the external force determining unit 15 starts the door-opening operation by using the electric motor MR. Specifically, the external force determining unit 15 outputs the control command $w_{opn}$ to the sequence controller 1. The sequence controller 1 starts the door-opening operation in response to receiving the control command $w_{opn}$ so that the end door SD is opened by the electric power. That is, the external force determining unit 15 continuously moves the end door SD being manually opened by a person in the opening direction by using the electric power.

If the external force determining unit 15 determines that the estimated external force value $f_{est}$ has been smaller than or equal the predetermined value Ft for the predetermined time period D3A or longer (YES in the step ST3E3), the external force determining unit 15 determines that the end door SD is being opened by a non-human external force. That is, even if the displacement amount detecting unit 12 and the deceleration amount detecting unit 13 determine that the end door SD is being manually opened by a person, if the external force determining unit 15 determines that the estimated external force value $f_{est}$ has been smaller or equal to the predetermined value Ft for the predetermined time period D3A or longer, the external force determining unit 15 ultimately determines that the end door SD is being opened by a non-human external force. The kinetic behavior of the end door SD illustrated in FIG. 5 corresponds to this case.

If it is determined that the displacement amount of the end door SD does not exceed the predetermined value Lt (NO in step ST3E1), the deceleration amount detecting unit 13 determines that the end door SD is being opened by a non-human external force without performing the determination of step ST3E2. That is, if the displacement amount detecting unit 12 determines that the end door SD is being opened by a non-human external force, the deceleration amount detecting unit 13 determines that the end door SD is being opened by a non-human external force without determining whether the deceleration amount DC in the predetermined time period D2 is greater than or equal to the predetermined value DCt.

If the deceleration amount detecting unit 13 determines that the end door SD is being opened by a non-human external force, the external force determining unit 15 ultimately determines that the end door SD is being opened by a non-human external force without determining whether the estimated external force value $f_{est}$ has been smaller than or equal to the predetermined value Ft for the predetermined time period D3A or longer.

Similarly, if it is determined that the deceleration amount DC in the predetermined time period D2 is greater than or equal to the predetermined value DCt (YES in step ST3E2), the external force determining unit 15 ultimately determines that the end door SD is opened by a non-human external force without performing the determination in step ST3E3. That is, if it the deceleration amount detecting unit 13 determines that the end door SD is being opened by a non-human external force, the external force determining unit 15 determines that the end door SD is being opened by a non-human external force without determining whether the estimated external force value $f_{est}$ has been smaller than or equal to the predetermined value Ft for the predetermined time period D3A or longer.

In these cases, in step ST5, the external force determining unit 15 starts the door-closing operation by using the electric motor MR. Specifically, the external force determining unit 15 outputs the control command $w_{cls}$ to the sequence controller 1. The sequence controller 1 starts the closing door operation in response to receiving the control command $w_{cls}$ so that the end door SD being opened by an external force other than manual force is closed by the electric power.

Figure 5:
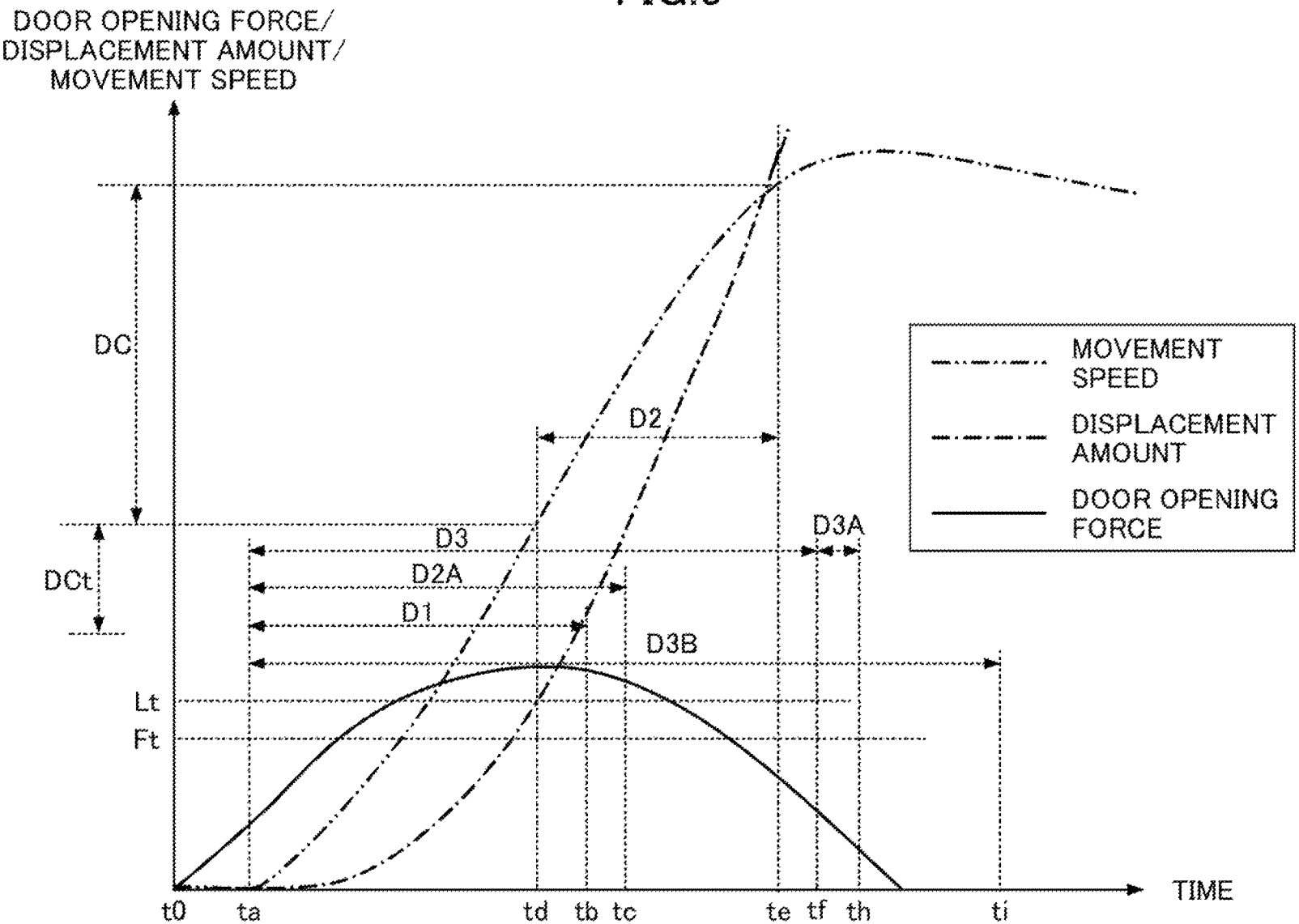
FIG. 5 is a drawing illustrating changes of a door opening force of the railroad car end door, the amount of movement of the railroad car end door, and the speed of movement of the railroad car end door.

Specifically, as illustrated in FIG. 5, when the door opening force applied to the end door SD, the displacement amount of the end door SD, and the movement speed of the end door SD change, the sequence controller 1 detects that the end door SD is being opened at the time to and generates a braking force.

The displacement amount detecting unit 12 determines at the time td that the displacement amount of the end door SD exceeds the predetermined value Lt before the predetermined time period D1 has elapsed. In this case, the displacement amount detecting unit 12 determines that the end door SD is being manually opened by a person and outputs the control command $w_{opn}$ to the deceleration amount detecting unit 13.

The deceleration amount detecting unit 13 determines at the time tc that the predetermined time period D2A has elapsed, and determines at the time to that the deceleration amount DC in the predetermined time period D2 is not greater than or equal to the predetermined value DCt. In this case, the deceleration amount detecting unit 13 determines that the end door SD is being manually opened by a person and outputs the control command $w_{opn}$ to the external force determining unit 15.

However, even if the displacement amount detecting unit 12 and the deceleration amount detecting unit 13 each output the control command $w_{opn}$, if the external force determining unit 15 determines at the time tf that the predetermined time period D3 has elapsed from when the generation of the braking force has started, and determines at the time th that the estimated external force value $f_{est}$ has been smaller than or equal to the predetermined value Ft for the predetermined time period D3A or longer, the external force determining unit 15 ultimately determines that the end door SD is being opened by a non-human external force. That is, even if the displacement amount detecting unit 12 and the deceleration amount detecting unit 13 each determine that the end door SD is being manually opened by a person, the external force determining unit 15 ultimately determines that the end door SD is being opened by a non-human external force. In this case, the external force determining unit 15 outputs the control command $w_{cls}$ to the sequence controller 1. The sequence controller 1 starts the closing door operation in response to receiving the control command $w_{cls}$ and so that the end door SD being opened by a non-human external force is closed by the electric power.

Next, with reference to FIGS. 18 to 22, assist processes performed in control systems CS of a sixth embodiment to a tenth embodiment will be described.

Figure 18:
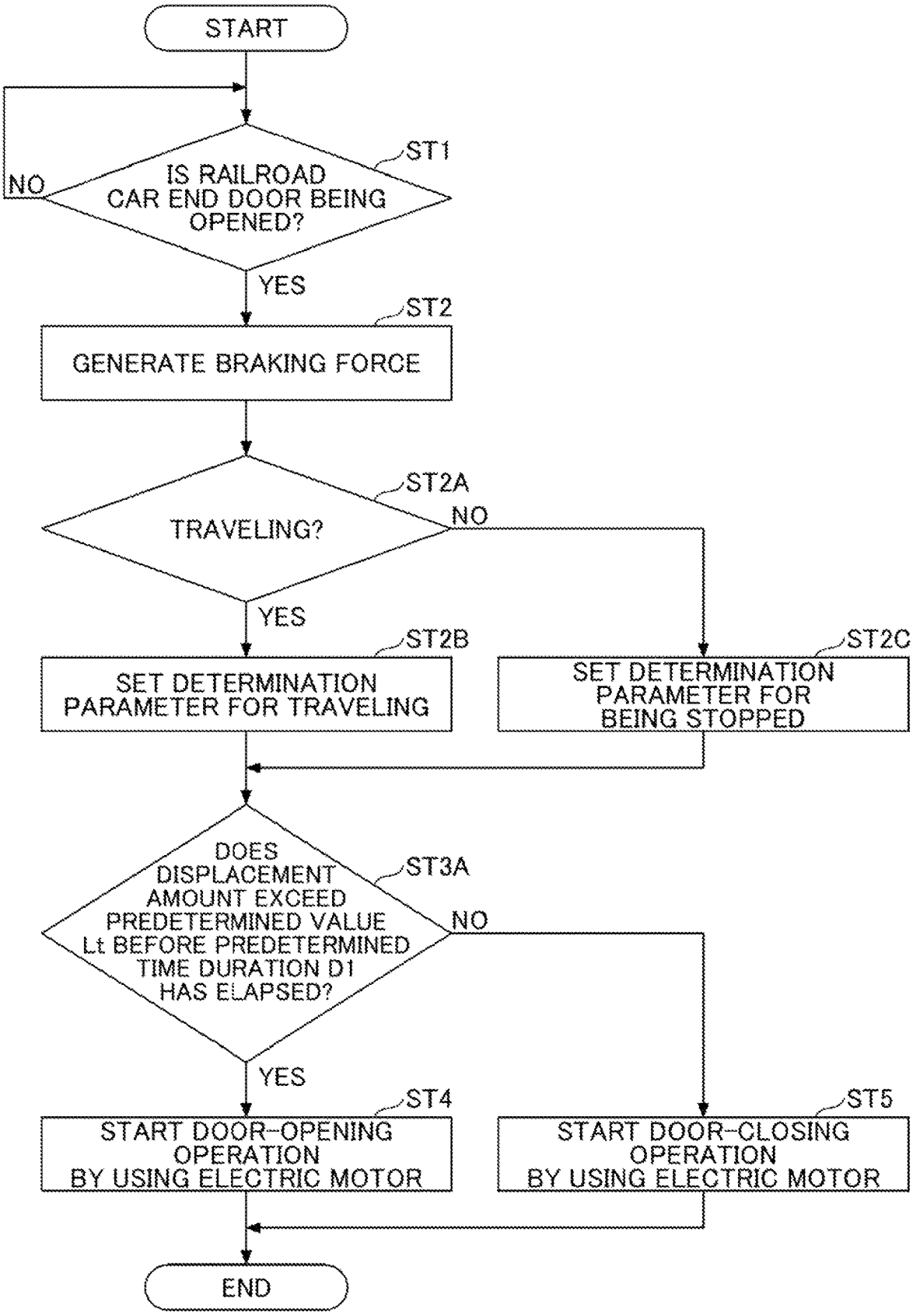
FIG. 18 is a flowchart of an assist process performed by a control system according to a sixth embodiment.

FIG. 18 is a flowchart of the assist process performed in the control system CS of the sixth embodiment. The flowchart illustrated in FIG. 18 differs from the flowchart illustrated in FIG. 9 regarding the assist process performed in the control system CS of the first embodiment in that the flowchart includes steps ST2A to ST2C. However, the flowchart illustrated in FIG. 9 and the flowchart illustrated in FIG. 18 have other features in common.

Figure 19:
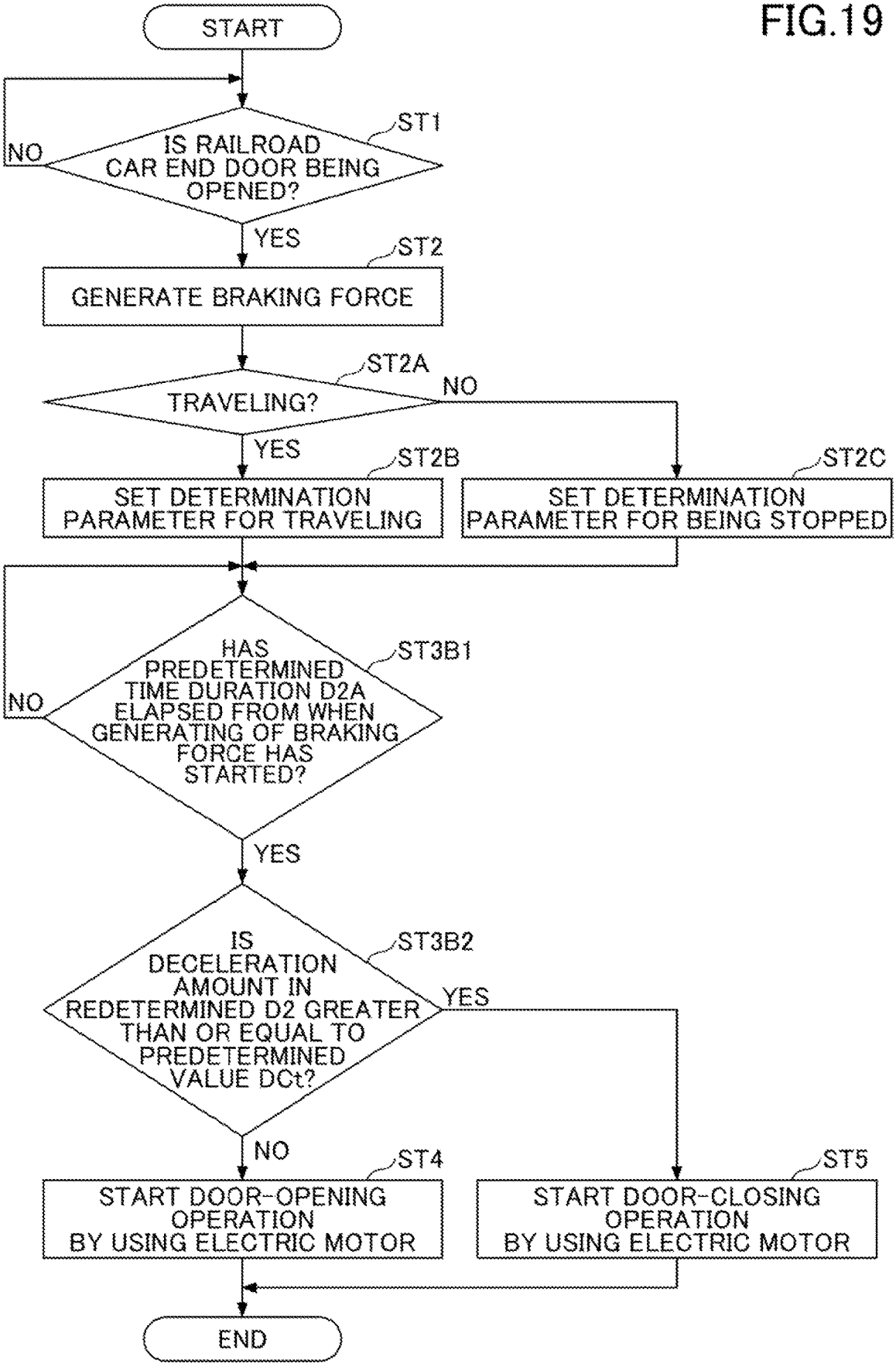
FIG. 19 is a flowchart of an assist process performed by a control system according to a seventh embodiment.

FIG. 19 is a flowchart of the assist process performed in the control system CS of the seventh embodiment. The flowchart illustrated in FIG. 19 differs from the flowchart illustrated in FIG. 11 regarding the assist process performed in the control system CS of the second embodiment in that the flowchart includes steps ST2A to ST2C. However, the flowchart illustrated in FIG. 11 and the flowchart illustrated in FIG. 19 have other features in common.

Figure 20:
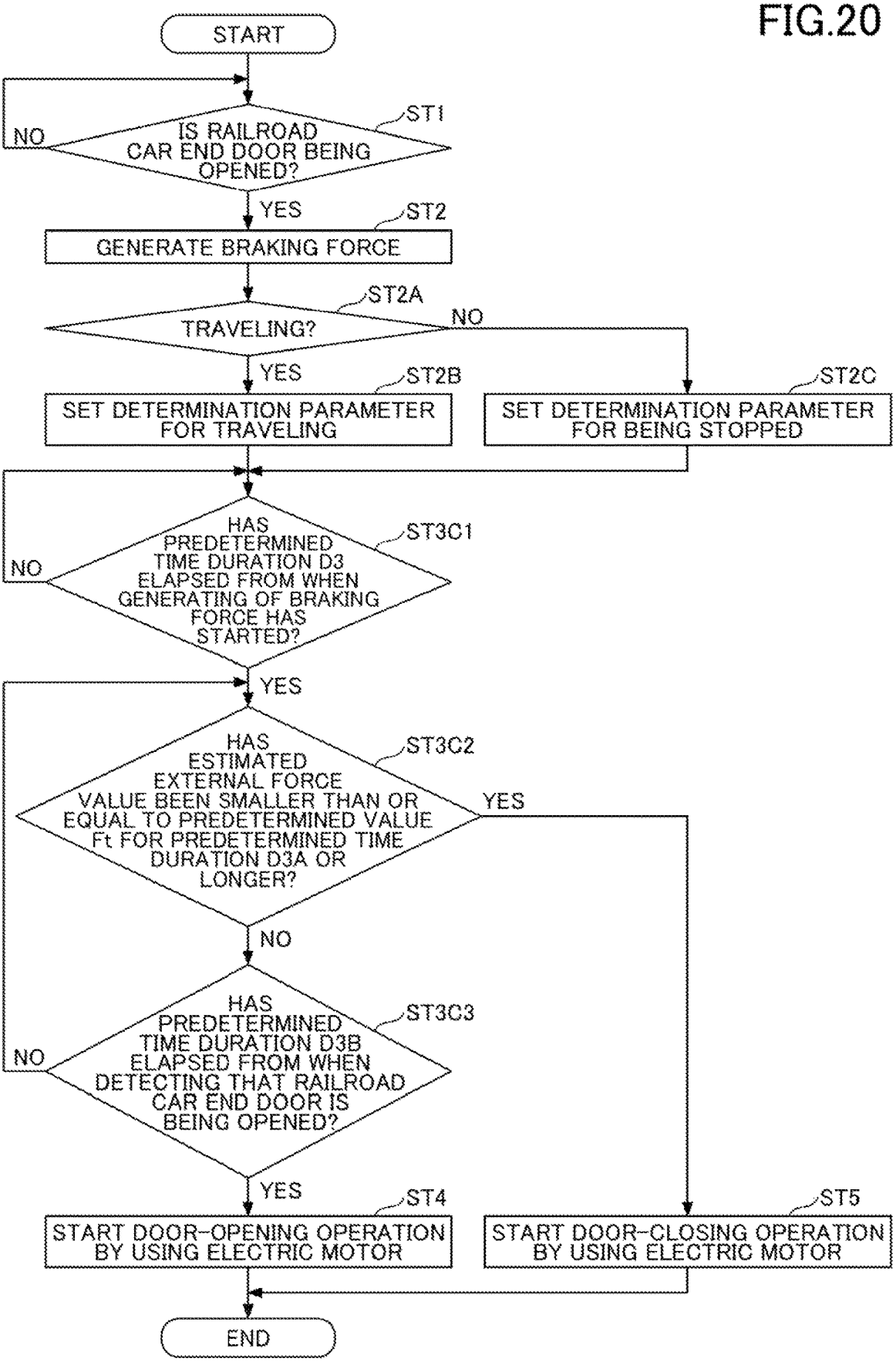
FIG. 20 is a flowchart of an assist process performed by a control system according to an eighth embodiment.

FIG. 20 is a flowchart of the assist process performed in the control system CS of the eighth embodiment. The flowchart illustrated in FIG. 20 differs from the flowchart illustrated in FIG. 13 regarding the assist process performed in the control system CS of the third embodiment in that the flowchart includes steps ST2A to ST2C. However, the flowchart illustrated in FIG. 13 and the flowchart illustrated in FIG. 20 have other features in common.

Figure 21:
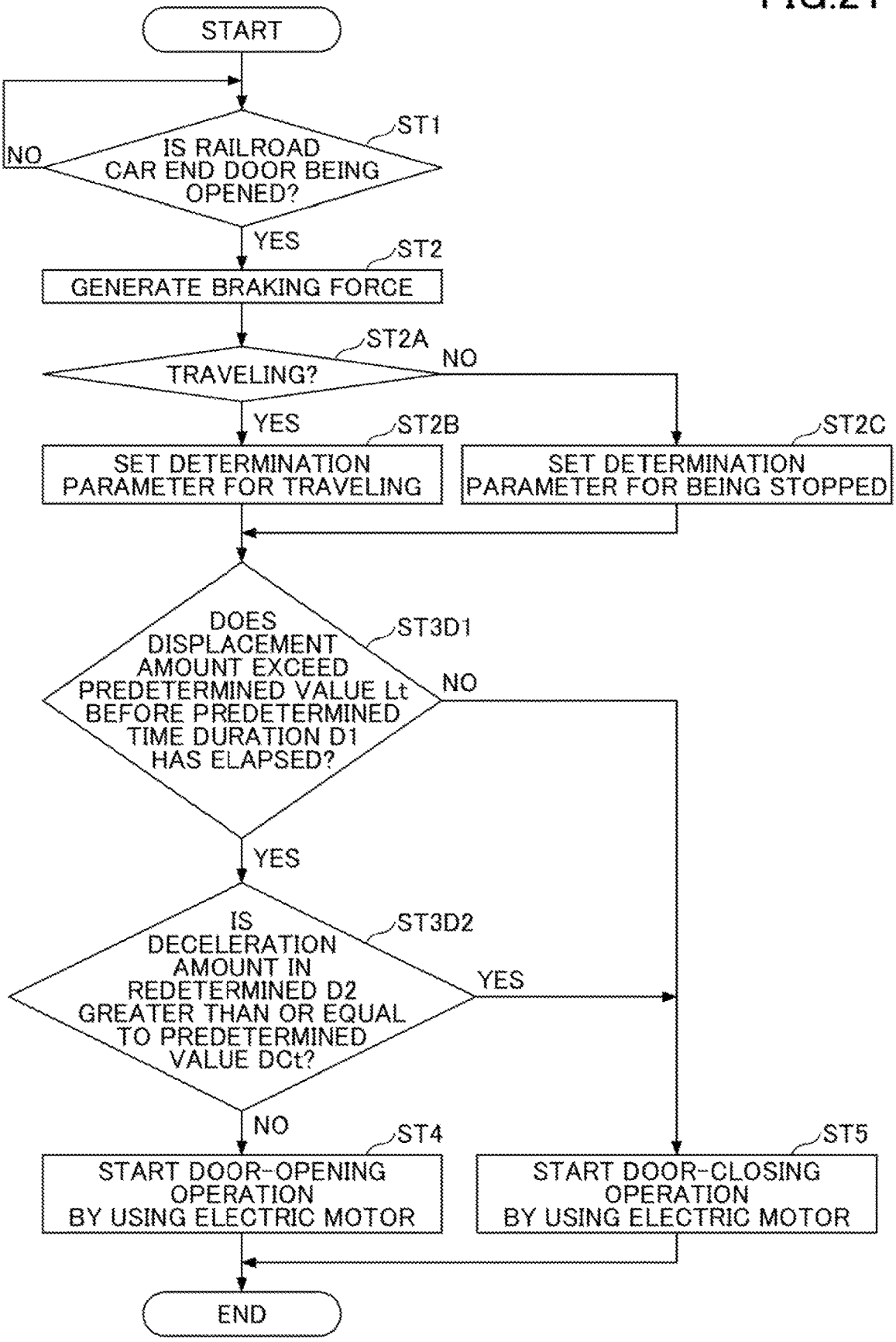
FIG. 21 is a flowchart of an assist process performed by a control system according to a ninth embodiment.

FIG. 21 is a flowchart of the assist process performed in the control system CS of the ninth embodiment. The flowchart illustrated in FIG. 21 differs from the flowchart illustrated in FIG. 15 regarding the assist process performed in the control system CS of the fourth embodiment in that the flowchart includes steps ST2A to ST2C. However, the flowchart illustrated in FIG. 15 and the flowchart illustrated in FIG. 21 have other features in common.

Figure 22:
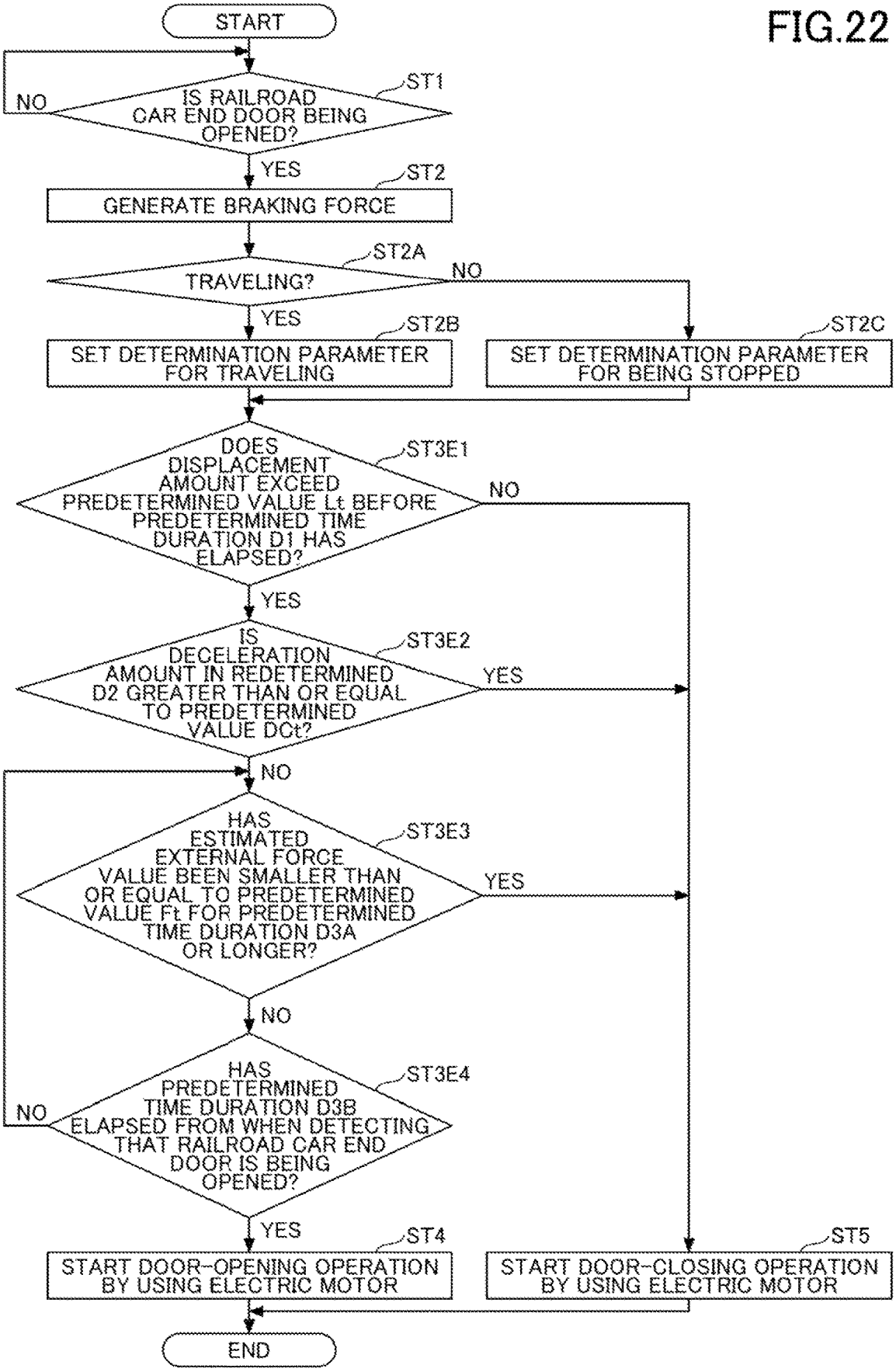
FIG. 22 is a flowchart of an assist process performed by a control system according to a tenth embodiment.

FIG. 22 is a flowchart of the assist process performed in the control system CS of the tenth embodiment. The flowchart illustrated in FIG. 22 differs from the flowchart illustrated in FIG. 17 regarding the assist process performed in the control system CS of the fifth embodiment in that the flowchart includes steps ST2A to ST2C. However, the flowchart illustrated in FIG. 17 and the flowchart illustrated in FIG. 22 have other features in common.

In the examples illustrated in each of FIGS. 18 to 22, after the generation of the braking force has started, in step ST2A, the control device CD determines whether the railroad car is traveling. This is for switching the determination parameter contents between when the railroad car is traveling and when the railroad car is stopped.

Specifically, if the control device CD determines that the railroad car is traveling (YES in step ST2A), in step ST2B, the control device CD sets a determination parameter for traveling, and if the control device CD determines that the railroad car is not traveling (NO in step ST2A), in step ST2C, the control device CD sets a determination parameter for being stopped.

The determination parameter is a setting value used in the assist process. The determination parameter is typically stored in a non-volatile storage in the control device CD in advance. The determination parameter is typically set as a non-zero value, but may also be zero. The determination parameter for travelling is a determination parameter used when the railroad car is traveling, and the determination parameter for being stopped is a determination parameter used when the railroad car is stopped.

In the sixth embodiment illustrated in FIG. 18, determination parameters for traveling and for being stopped include the predetermined time period D1 and the predetermined value Lt related to the travel amount of the end door SD. The predetermined time period D1 used as the determination parameter for traveling is typically greater than the predetermined time period D1 used as the determination parameter for being stopped. The same applies to the predetermined value Lt.

In the seventh embodiment illustrated in FIG. 19, the determination parameters for traveling and for being stopped include the predetermined time period D2, the predetermined time period D2A, and the predetermined value DCt related to the deceleration amount of the end door SD. The predetermined time period D2 used as the determination parameter for traveling is typically greater than the predetermined time period D2 used as the determination parameter for being stopped. The same applies to the predetermined time period D2A and the predetermined value DCt.

In the eighth embodiment illustrated in FIG. 20, the determination parameters for traveling and for being stopped include the predetermined time period D3, the predetermined time period D3A, the predetermined time period D3B, and the predetermined value Ft related to the estimated external force value $f_{est}$. The predetermined time period D3 used as the determination parameter for traveling is typically greater than the predetermined time period D3 used as the determination parameter for being stopped. The same applies to the predetermined time period D3A, the predetermined time period D3B, and the predetermined value Ft.

In the ninth embodiment illustrated in FIG. 21, the determination parameters for traveling and for being stopped include the predetermined time period D1, the predetermined time period D2, the predetermined value Lt related to the displacement amount of the end door SD, and the predetermined value DCt related to the deceleration amount of the end door SD. The predetermined time period D1 used as the determination parameter for traveling is typically greater than the predetermined time period D1 used as the determination parameter for being stopped. The same applies to the predetermined time period D2, the predetermined value Lt, and the predetermined value DCt.

In the tenth embodiment illustrated in FIG. 22, the determination parameters for traveling and for being stopped include the predetermined time period D1, the predetermined time period D2, the predetermined time period D3A, the predetermined time period D3B, the predetermined value Lt related to the displacement amount of the end door SD, the predetermined value DCt related to the deceleration amount of the end door SD, and the predetermined value Ft related to the estimated external force value $f_{est}$. The predetermined time period D1 used as the determination parameter for traveling is typically greater than the predetermined time period D1 used as the determination parameter for being stopped. The same applies to the predetermined time period D2, the predetermined time period D3A, the predetermined time period D3B, the predetermined value Lt, the predetermined value DCt, and the predetermined value Ft.

As described above, the control system CS according to the embodiments of the present invention is the control system CS of the electric end door SD, for example, illustrated in FIG. 1, and is configured to begin generating a braking force at the opening of the end door SD and determine whether the end door SD is being manually opened by a person based on information related to a state of the end door SD while the braking force is being generated. With this configuration, the control system CS can detect that a person is opening the end door SD. Therefore, the control system CS can perform various functions after accurately detecting that the end door SD is being manually opened by a person. For example, the control system CS can reduce the load required when a person opens the end door SD. This is because an operation of reducing the load required when a person opens the end door SD (which will be hereinafter referred to as an "assisting operation") can be started after accurately detecting that the end door SD is being manually opened by a person. The assisting operation is, for example, an operation of opening the end door by using the electric power. The assisting operation may be an operation of releasing the braking force. Additionally, the control system CS prevents the assisting operation from starting by mistake although a person does not open the end door SD. This is because the control system CS can accurately detect that the end door SD is not being manually opened by a person.

The information related to the state of the end door SD may be, for example, at least one of the displacement amount of the end door SD, the deceleration amount of the end door SD, and the estimated external force value acting on the end door SD. Specifically, the information related to the state of the end door SD is the position information s derived from the pulse signal p output by the encoder 8, the actual speed value v, the thrust force command value f*, or the actual thrust force value f, for example. With this configuration, the control system CS can simply and accurately determine whether the end door SD is being manually opened by a person.

As illustrated in FIG. 9, the control system CS may determine that the end door SD is being manually opened by a person if the displacement amount of the end door SD is greater than the predetermined value Lt when the predetermined time period D1 has elapsed while the braking force is being generated, for example. Alternatively, the control system CS may determine that the end door SD is being manually opened by a person if the displacement amount of the end door SD exceeds the predetermined value Lt before the predetermined time period D1 has elapsed. With this configuration, the control system CS can accurately determine, based on the displacement amount of the end door SD that varies in accordance with the magnitude and the duration of an external force to move the end door SD to which the braking force is applied, whether the external force is a human force or a non-human external force. As a result, the control system CS can more reliably and timely reduce the load required when a person opens the end door SD.

Alternatively, as illustrated in FIG. 11, the control system CS may determine that the end door SD is being manually opened by a person if the deceleration amount of the end door SD in the predetermined time period D2 is less than the predetermined value DCt while the braking force is being generated, for example. In this case, a start time of the predetermined time period D2 may be, for example, when the displacement amount of the end door SD exceeds the predetermined value Lt, or when a certain time period has elapsed from the opening of the end door SD. A case in which the deceleration amount DC is less than the predetermined value DCt may include a case in which the end door SD is accelerating. With this configuration, the control system CS can accurately determine, based on the deceleration amount of the end door SD that varies in accordance with the magnitude and the duration of an external force to move the end door SD to which the braking force is applied, whether the external force is a human force or a non-human external force. As a result, the control system CS can more reliably and timely reduce the load required when a person opens the end door SD.

Alternatively, for example, as illustrated in FIG. 13, the control system CS may determine that the end door SD is being manually opened by a person if the estimated external force value Pest, which is an estimated value of a force estimated by the state observer unit 14, is greater than the predetermined value Ft even after the predetermined time period D3A has elapsed from when the generation of the braking force has started. Alternatively, the control system CS may determine that the end door SD is being manually opened by a person if the estimated external force value $f_{est}$ does not fall below the predetermined value Ft after the predetermined time period D3A has elapsed.

In this case, the predetermined value Ft related the estimated external force value $f_{est}$ is preferably greater than or equal to a value equivalent to a component force of gravity acting on the end door SD in the movement direction of the end door SD when a car equipped with the end door SD stops at the maximum cant. The determination based on the estimated external force value $f_{est}$ is preferably started when the displacement amount of the end door SD exceeds the predetermined value Lt or when a predetermined time has elapsed from the opening of the end door SD. For example, the determination based on the estimated external force value $f_{est}$ preferably starts when detecting that the end door SD is being opened.

With this configuration, the control system CS can accurately determine, based on the estimated external force value $f_{est}$ that varies in accordance with the magnitude and the duration of an external force to move the end door SD to which the braking force is applied, whether the external force is a human force or a non-human external force. As a result, the control system CS can more reliably and timely reduce the load required when a person opens the end door SD.

Alternatively, the control system CS may be configured to determine that the end door SD is being manually opened by a person if at least two of the following first, second, and third conditions are satisfied. The first condition is that the displacement amount of the end door SD when the predetermined time period D1 has elapsed while the braking force is being generated is greater than the predetermined value Lt (e.g., step ST3A illustrated in FIG. 9). The second condition is that the deceleration amount of the end door SD in the predetermined time period D2 while the braking force is being generated is less than the predetermined value DCt (for example, step ST3B2 illustrated in FIG. 11). The third condition is that the estimated external force value $f_{est}$, which is an estimated value of a force estimated by the state observer unit 14, is greater than the predetermined value Ft even after a predetermined time has elapsed from when the generation of the braking force has started (e.g., step ST3C2 illustrated in FIG. 13).

For example, the control system CS may be configured to determine that the end door SD is being manually opened by a person if two conditions are satisfied in the order of the first condition and the second condition (e.g., step ST3D1 and step ST3D2 of FIG. 15), if two conditions are satisfied in the order of the second condition and the third condition, if two conditions are satisfied in the order of the first condition and the third condition, or if three conditions are satisfied in the order of the first condition, the second condition, and the third condition (e.g., steps ST3E1 to ST3E3 of FIG. 17).

With this configuration, the control system CS can more accurately determine, based on at least two of the displacement amount of the end door SD, the deceleration amount of the end door SD, and the estimated external force value $f_{est}$ that vary in accordance with the magnitude and the duration of an external force to move the end door SD to which the braking force is applied, whether the external force is a human force or a non-human external force. As a result, the control system CS can more reliably and timely reduce the load required when a person opens the end door SD.

The setting value used to determine whether the end door SD is being manually opened by a person may be switched depending on whether a car equipped with the end door SD is travelling, whether a car equipped with the end door SD is stopped, or whether a car equipped with the end door SD is traveling or stopped, as illustrated in steps ST2A to ST2C in FIGS. 18 to 22, for example. With this configuration, the control system CS can perform a determination earlier when the railroad car is stopped than when the railroad car is traveling, for example. Therefore, the control system CS can further reduce the load required when a person opens the end door by starting the door-opening operation earlier. Alternatively, the control system CS can perform a determination more accurately (i.e., more strictly) when the railroad car is traveling than when the railroad car is stopped, for example. Therefore, the control system CS can more reliably prevent an erroneous determination.

The control system CS may determine that the end door SD is being opened by a non-human external force when the control system CS determines that the end, door SD is not being manually opened by a person. That is, the control system CS may determine whether the end door SD is being manually opened by a person or whether the end door SD is being opened by a non-human external force.

The control system CS may be configured to open the end door SD by using the electric motor MR when the control system CS determines that the end door SD is being manually opened by a person, for example, as illustrated in step ST4 of FIG. 2. With this configuration, the control system CS can open the end door SD without a force applied by a person. Therefore, the control system CS can reliably reduce the load required when a person opens the end door SD.

The control system CS may be configured to close the end door SD by using the electric motor MR if the control system CS determines that the end door SD is being opened by a non-human external force, for example, as illustrated in step ST5 of FIG. 9. With this configuration, the control system CS can immediately close the end door SD even when the end door SD is being opened by a non-human external force. The control system CS can reliably reduce the load required when a person opens the sliding door by starting the assist process without delay when a person is opening the end door SD subsequently.

The control device CD according to the embodiments of the present invention is the control device CD of the electric end door SD illustrated in FIG. 1 for example, and is configured to begin generating a braking force at the opening of the end door SD and determine whether the end door SD is being manually opened by a person based on information related to a state of the end door SD while the braking force is being generated. With this configuration, the control device CD can detect that a person is opening the end door SD. Therefore, the control device CD can perform various functions after accurately detecting that the end door SD is being manually opened by a person. For example, the control device CD can reduce the load required when a person opens the end door SD. This is because the control device CD can start the assist process after accurately detecting that the end door SD is being manually opened by a person.

A control program according to the embodiments of the present invention is a control program for the electric end door and is configured to achieve a function, in a computer (i.e., a microcomputer), of starting to generate a braking force at the opening of the end door SD and determining whether the end door SD is being manually opened by a person based on information related to a state of the end door SD while the braking force is being generated. The control program is typically recorded on a computer-readable recording medium. The recording medium on which the control program is recorded may be distributed as a program product.

Figure 23:
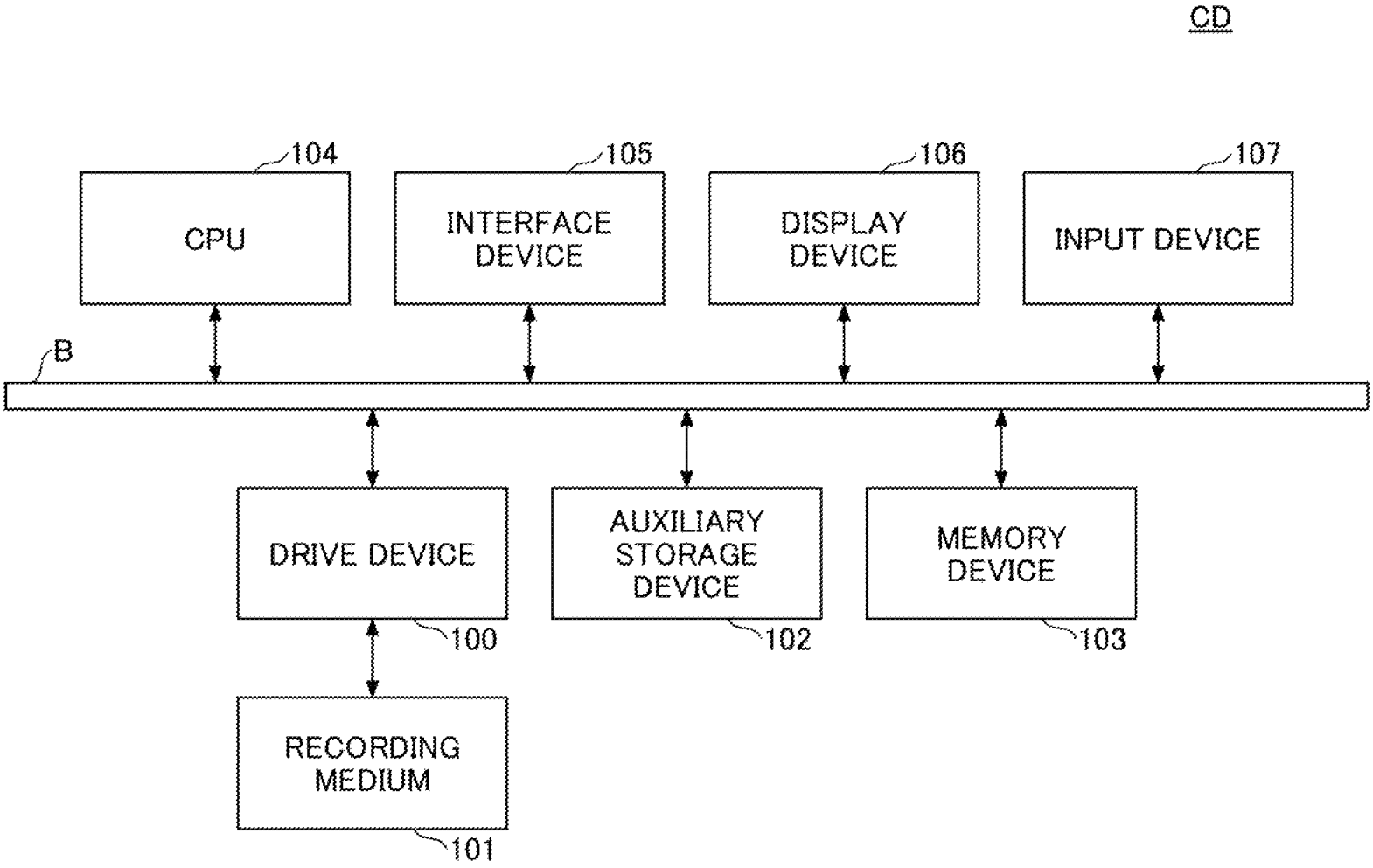
FIG. 23 is a drawing illustrating a configuration example of a control device.

FIG. 23 is a diagram illustrating a hardware configuration example of the control device CD. The control device CD illustrated in FIG. 23 includes a drive device 100 interconnected through a bus B, an auxiliary storage device 102, a memory device 103, a CPU 104, an interface device 105, a display device 106, and an input device 107. The control program that implements the functions of the control device CD is provided by a recording medium 101, such as a CD-ROM. When the recording medium 101 on which the control program is recorded is set in the drive device 100, the control program is installed in the auxiliary storage device 102 from the recording medium 101 through the drive device 100. However, the control program is not necessarily required to be installed through the recording medium 101, but may be downloaded and installed from another computer through a network. The auxiliary storage device 102 is configured to store the installed program and necessary data, for example. The memory device 103 is configured to read out the program from the auxiliary storage device 102 and store the program in response to receiving an instruction to start the control program. The CPU 104 is configured to achieve the functions of the control device CD by executing the program stored in the memory device 103. The interface device 105 is used as an interface for connecting to a network. The display device 106 is configured to display information about the control program or the like. The input device 107 includes a keyboard or a mouse, and is used to input various instructions to the control device CD.

The embodiments of the present invention have been described in detail above. However, the invention is not limited to the above-described embodiments. Various modifications, substitutions, and the like can be made to the above-described embodiments without departing from the scope of the invention. The features described with reference to the above-described embodiments may also be suitably combined, as long as there is no technical inconsistency.

What is claimed is:

1. A control system for an electrically-operated railroad car end door comprising:

an actuator configured to apply a braking force to the railroad car end door;

an information obtaining device configure to measure information related to the railroad car end door;

a processor; and a memory storing program instructions that cause the processor to control the actuator to apply the braking force to the railroad car end door in response to detecting that the railroad car end door is moved in an opening direction based on the measured information, and determine whether the railroad car end door is being manually opened by a person based on information related to a state of the railroad car end door while the braking force is being applied, the information related to the state of the railroad car end door being generated based on the measured information.

2. The control system as claimed in claim 1, wherein the information related to the state of the railroad car end door is a displacement amount of the railroad car end door, and wherein the processor determines that the railroad car end door is being manually opened by the person in a case where the displacement amount of the railroad car end door exceeds a predetermined value when a predetermined time period has elapsed while the braking force is being generated.

3. The control system as claimed in claim 1, wherein the information related to the state of the railroad car end door is a deceleration amount of the railroad car end door in a predetermined time period while the braking force is being generated, and wherein the processor determines that the railroad car end door is being manually opened by the person in a case where the deceleration amount of the railroad car end door is below a predetermined value.

4. The control system as claimed in claim 3, wherein the predetermined time period starts when a displacement amount of the railroad car end door exceeds a predetermined value.

5. The control system as claimed in claim 3, wherein the predetermined time period starts when a predetermined time period has elapsed from the opening of the railroad car end door.

6. The control system as claimed in claim 1, wherein the program instructions further cause the processor to calculate an estimated value of an external force acting on the railroad car end door, wherein the information related to the state of the railroad car end door is the estimated value of the external force, and wherein the processor determines that the railroad car end door is being manually opened by the person in a case where the estimated value of the external force exceeds a predetermined value even after a predetermined time period has elapsed from when the generation of the braking force has started.

7. The control system as claimed in claim 6, wherein the predetermined value related to the estimated value of the external force is greater than or equal to a value equivalent to a component force of gravity in a movement direction of the railroad car end door, the gravity acting on the railroad car end door when a car equipped with the railroad car end door stops at a maximum cant.

8. The control system as claimed in claim 6, wherein the processor starts determining whether the railroad car end door is being manually opened by the person in response to a displacement amount of the railroad car end door exceeding a predetermined value or from when a predetermined time period has elapsed from the opening of the railroad car end door.

9. The control system as claimed in claim 1, wherein the program instructions further cause the processor to calculate an estimated value of a force acting on the railroad car end door, wherein the information related to the state of the railroad car end door is a displacement amount of the railroad car end door, a deceleration amount of the railroad car end door, and the estimated value of the force, and wherein the processor determines that the railroad car end door is being manually opened by the person in a case where at least two of a first condition, a second condition, and a third condition are satisfied, the first condition being that the displacement amount of the railroad car end door exceeds a predetermined value when a predetermined time period has elapsed while the braking force is being generated, the second condition being that the deceleration amount of the railroad car end door is below a predetermined value when a predetermined time period has elapsed while the braking force is being generated, and the third condition being that the estimated value of the force exceeds a predetermined value even after a predetermined time period has elapsed from when the generation of the braking force has started.

10. The control system as claimed in claim 9, wherein the processor determines that the railroad car end door is being manually opened by the person in the following cases: the first condition and the second condition are sequentially satisfied, the second condition and the third condition are sequentially satisfied, the first condition and the third condition are sequentially satisfied, or the first condition, the second condition, and the third condition are sequentially satisfied.

11. The control system as claimed in claim 1, wherein the processor switches a setting value used for determining whether the railroad car end door is being manually opened by the person, depending on whether a car equipped with the railroad car end door is traveling or whether the car equipped with the railroad car end door is stopped.

12. The control system as claimed in claim 1, wherein the processor determines that the railroad car end door is being opened by a non-human external force in a case where the processor does not determine that the railroad car end door is being manually opened by the person.

13. The control system as claimed in claim 1, wherein the actuator opens the railroad car end door in a case where the processor determines that the railroad car end door is being manually opened by the person.

14. The control system as claimed in claim 1, wherein the actuator closes the railroad car end door when the processor determines that the railroad car end door is being opened by a non-human external force.

15. The control system as claimed in claim 1, wherein the information related to the state of the railroad car end door is at least one of a displacement amount of the railroad car end door, a deceleration amount of the railroad car end door, or an estimated value of an external force acting on the railroad car end door.

16. The control system as claimed in claim 1, wherein the actuator is configured to convert electrical energy to mechanical energy to apply the braking force to the railroad car end door and the processor is configured to control the electrical energy supplied to the actuator.

17. The control system as claimed in claim 16, wherein the actuator is a motor and the information obtaining device is a sensor configured to detect a position of the railroad car end door.

18. A control device for an electrically-operated railroad car end door comprising:

a processor; and a memory storing program instructions that cause the processor to control to apply the braking force to the railroad car end door in response to detecting that the railroad car end door is moved in an opening direction based on information related to the railroad car end door, the information related to the railroad car end door being measured by an information obtaining device; and determine whether the railroad car end door is being manually opened by a person based on information related to a state of the railroad car end door while the braking force is being applied, the information related to the state of the railroad car end door being generated based on the measured information.

19. A non-transitory computer-readable recording medium having stored therein a control program for an electrically-operated railroad car end door for causing a computer to execute a process comprising:

controlling to apply the braking force to the railroad car end door in response to detecting that the railroad car end door is moved in an opening direction based on information related to the railroad car end door, the information related to the railroad car end door being measured by an information obtaining device; and determining whether the railroad car end door is being manually opened by a person based on information related to a state of the railroad car end door while the braking force is being applied, the information related to the state of the railroad car end door being generated based on the measured information.

* * * * *